US005546685A

United States Patent [19]

Gallagher

[11] Patent Number: 5,546,685

[45] **Date of Patent: * Aug. 20, 1996**

[54] DISPLAY APPARATUS FOR DESIRED ITEMS WITH EASY EXCHANGE OF DESIRED ITEMS, AND WITH PROTECTION FROM ULTRA-VIOLET LIGHT

[76] Inventor: Gerald B. Gallagher, 9 Main St., Acton, Mass. 01720

[ * ] Notice: The portion of the term of this patent subsequent to Dec. 13, 2011, has been disclaimed.

[21] Appl. No.: 905,882

[22] Filed: Jun. 29, 1992

Related U.S. Application Data

[63] Continuation-in-part of Ser. No. 807,992, Dec. 16, 1991, Pat. No. 5,371,963.

[51] Int. Cl.[6] ..... B44C 5/02

[52] U.S. Cl. ..... 40/768; 40/700; 40/772; 40/780

[58] Field of Search ..... 40/152, 158.1, 40/157, 156, 158.2

[56] References Cited

U.S. PATENT DOCUMENTS

| | | | |
|---|---|---|---|
| 3,371,439 | 3/1968 | Smith . | |
| 3,707,053 | 12/1972 | Itano | 40/158.1 |
| 3,994,088 | 11/1976 | Ohfuji | 40/158.1 |
| 4,138,786 | 2/1979 | Smith . | |
| 4,157,626 | 6/1979 | Bedinghaus . | |
| 4,231,833 | 11/1980 | Lieberman | 156/249 |
| 4,345,394 | 8/1982 | Sullivan . | |
| 4,424,637 | 1/1984 | Leahy . | |
| 4,545,140 | 10/1985 | Winston . | |
| 4,648,189 | 3/1987 | Michel | 40/546 |
| 4,706,397 | 11/1987 | Hesener . | |
| 4,761,903 | 8/1988 | Cantrell . | |
| 4,794,714 | 1/1989 | Weisgerber | 40/158.1 |
| 4,879,824 | 11/1989 | Galloway . | |
| 4,889,748 | 12/1989 | Dudley . | |
| 4,947,565 | 8/1990 | Shadwell . | |
| 4,964,231 | 10/1990 | DeMaat . | |
| 4,967,499 | 11/1990 | Rosenberg . | |
| 4,991,336 | 2/1991 | Lucke . | |
| 5,148,618 | 9/1992 | Brewster | 40/152 X |

*Primary Examiner*—Milton Nelson, Jr.

[57] ABSTRACT

A display system for items, the system featuring easy substitution of a second group of items for a first group of items is provided. A display assembly has a frame, a mat, a retainer for the items, and a backing board. Pins inserted through holes anchor the retainer to either the backing board or the mat. The transparent plate may be made of ultra-violet light absorbing material in order to protect the desired materials from ultraviolet radiation striking the transparent plate. The pins may be formed as part of a pin strip, the pin strip formed by plastic molding, and the pins inserted into holes in the backing board. The pins may be wood dowels or may be aluminum rods. The aluminum rods may have a flat head formed thereon.

24 Claims, 32 Drawing Sheets

122

502

DISPLAY APPARATUS FOR DESIRED ITEMS WITH EASY EXCHANGE OF DESIRED ITEMS, AND WITH PROTECTION FROM ULTRA-VIOLET LIGHT

RELATED APPLICATION

This application is a continuation in part application of U.S. patent application, Ser. No. 7/807,992 filed on Dec. 16, 1991 by Gerald B. Gallagher for Display Apparatus for Desired Items with Easy Exchange of Desired Items, and with Protection from Ultra-Violet Light, now issued as U.S. Pat. No. 5,371,963 on Dec. 13, 1994.

FIELD OF THE INVENTION

This invention relates to the field of display apparatus such as picture frames and the like, and more particularly to protection and retention of desired materials in the picture frame.

BACKGROUND OF THE INVENTION

The permanent support of large desired materials in the window of a mat in a picture frame is accomplished by making the window in the mat slightly smaller than the desired materials, and attaching the desired materials by tape, glue, etc. to the rear of the mat.

The method of making the window in the mat smaller than the desired materials and then supporting the desired materials by attaching them to the mat by tape, glue, etc. is inadequate to mount many items into a picture frame. For example, it is often desired to display in a picture frame a selected item for a temporary time period, and then to exchange a new item for the old. The use of tape or glue is then an inconvenience when exchanging the items to be displayed.

A further inconvenience of the old method of mounting an item in a picture frame arises when it is desired to display several small items in a large window in a mat. An unsatisfactory method currently employed is to attach each small item to a backingboard by tape, glue, corner holders, or some other permanent or semi-permanent adhesive means. The backing board is then placed in the picture frame for the display of the small items. However, the adhesive attachment of the small items to the backing board is undesirable.

Still further, the display of interesting items such as stamps, other philatelic items, baseball cards, unusual monetary currency, or other items of interest within a window of a mat board is not convenient with available techniques. Even further, the protection of displayed items from the harmful effects of ultra-violet radiation from the sun, from fluorescent lights, or from any other source is often necessary. The use of ordinary transparent materials in the picture frame does not protect the desired items from ultra-violet radiation impinging on a frame holding the items for display.

It is desirable to mount a plurality of desired items for display in a picture frame type display system and to be able to easily remove a first set of items and replace them with a second set of items. It is further desirable to protect the displayed items from the harmful effects of incident ultra-violet radiation.

SUMMARY OF THE INVENTION

A display system for an item or a plurality of small items, the system featuring easy substitution of a second group of items for a first group of items, and featuring protection of the items from ultra-violet radiation is provided.

A display assembly has a frame, the frame forming a first opening for the display of desired materials; a transparent plate mounted within the frame and covering the first opening, the transparent plate permitting viewing of desired materials through the first opening and protecting the desired materials, the transparent plate having a first side turned away from an inside of the frame and a second side turned toward the inside of the frame; a mat mounted within the frame, the mat adjacent to the second side of the transparent plate, the mat having a second opening, the second opening forming a window for viewing the desired materials, the second opening in the mat being smaller than the first opening formed by the frame; a retainer to hold the desired materials in the second opening of the mat; a pressure board to compress the materials in the assembly; a backing board to form a back support in the frame to hold the transparent plate, the desired materials, the mat, the retainer, and the pressure board within the frame; attachment means for fastening the backing board within the frame to anchor the backing board to form the back support for the assembly. The transparent plate may be transparent to light in the visible wavelength range and absorbent or reflective in the ultra-violet wavelength range to protect the desired materials from ultra-violet wavelength radiation striking the transparent plate.

The transparent plate may be made of glass, plastic, or any other convenient material. Further, the retainer may be a pliable sheet of transparent material folded to capture the desired items within the fold of the retainer. The retainer is then sized to fit snugly within the frame.

A shaped pressure board is provided to fit between the retainer and the backing board to concentrate compressive forces on the edges of the retainer to better hold it in place between the backing board and the mat. A panel of desired color or design is placed between the retainer and the shaped pressure board so that the pressure board is not visible through the transparent material of the retainer.

A pressure board focuses compressive forces onto portions of the retainer between the mat and the backing board so as to more securely hold the retainer in place. Retainer clips apply compressive forces between the backing board and the mat, and the pressure board focuses these compressive forces onto the retainer.

Still further, the retainer may be a sheet of transparent material having holes formed therein. Pins inserted through the holes anchor the retainer to either the backing board or the mat.

The pins may be made of individual pins inserted through holes in a backing board, and the pins may have a head formed thereon. The pins may, for example, be formed by pressing a head onto an aluminum rod, or by forming a portion of an aluminum rod into a head.

The pins may be formed into a pin strip having a base with at least one pin formed with the base. The base and pins may be formed by plastic injection molding, or by other convenient means.

Elongated holes in an album page may be used to compensate for variations in manufacturing. Also, oval shaped pins used to retain an album page may be used to compensate for manufacturing variations.

BRIEF DESCRIPTION OF THE DRAWINGS

FIG. 15*d* is an exploded assembly drawing of a display frame assembly using a pin strip to secure an album page, several alternatives being shown.

FIG. 15*e* is a cross sectional view of FIG. 15*d* taken along sectional line 15E1–15E2.

DETAILED DESCRIPTION

Figure 1:
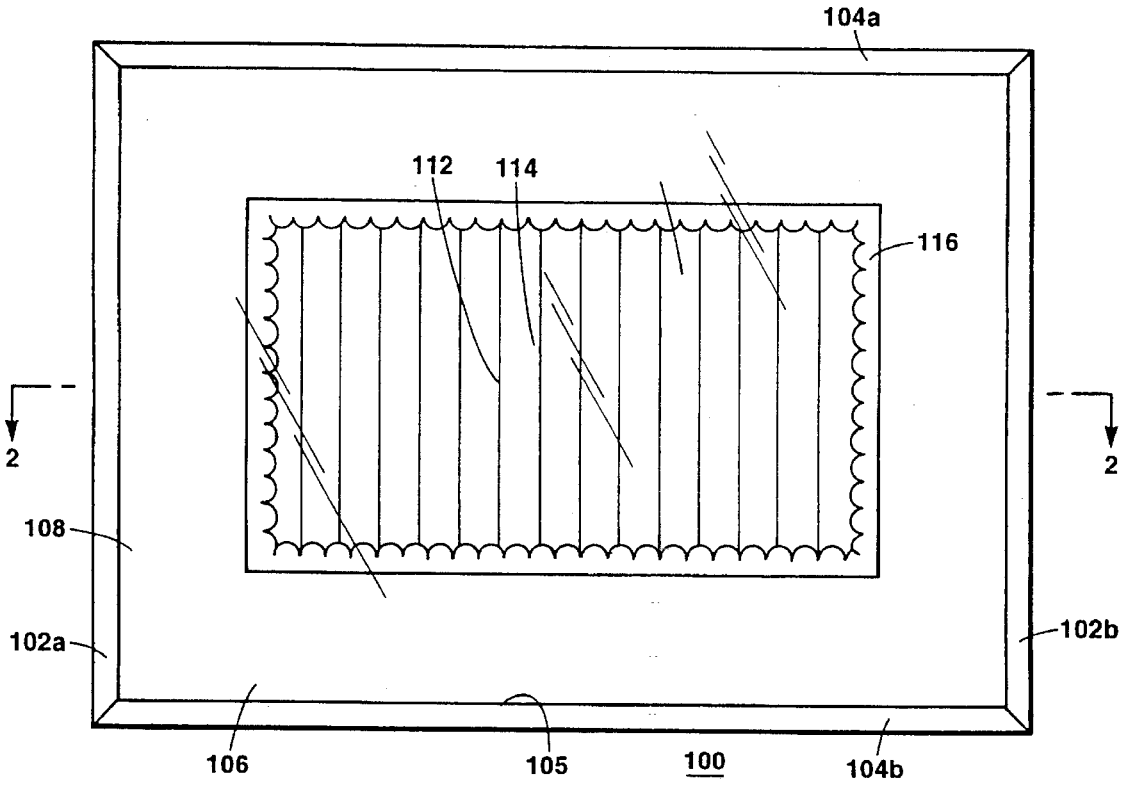
FIG. 1 is a front view of desired items displayed in a picture frame assembly.

In order to further illustrate the advantages and features of the invention, reference should be made to the following detailed description in connection with the accompanying drawings, Throughout the drawings, like reference numbers refer to like features of the present invention represented in the several views. The detailed description encompasses a number of exemplary embodiments, as shown in the drawings.

First Exemplary Embodiment

Beginning with FIG. 1, there is shown a front view of desired materials displayed in picture frame assembly 100. Picture frame assembly 100 is typically constructed of parallel frame legs 102*a*, 102*b* arranged perpendicular to parallel frame legs 104*a*, 104*b*. Frame legs 102*a*, 102*b*, 104*a*, 104*b* may be, for example, conventionally constructed of lightweight aluminum materials. Assembled frame legs 102*a*, 102*b*, 104*a*, 104*b* hold transparent plate 106 with front lip 105, as further shown in FIG. 2

A fundamental characteristic of the present invention is a unique combination of materials used in picture frame assembly 100. The present invention uses transparent plate 106 composed of ultraviolet absorbing or reflecting material. The preferred embodiment replaces an ordinary sheet of glass with a form of ultraviolet absorbing or reflecting material for transparent plate 106. Absorption of incident ultraviolet light by transparent plate 106 provides maximum protection and preservation of artwork 112 displayed in picture frame assembly 100.

Figure 2:
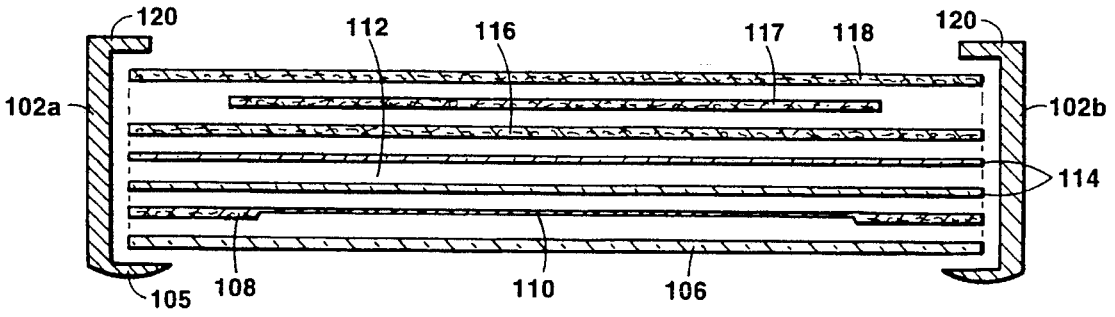
FIG. 2 is a cross sectional view of FIG. 1.
Figure 3:
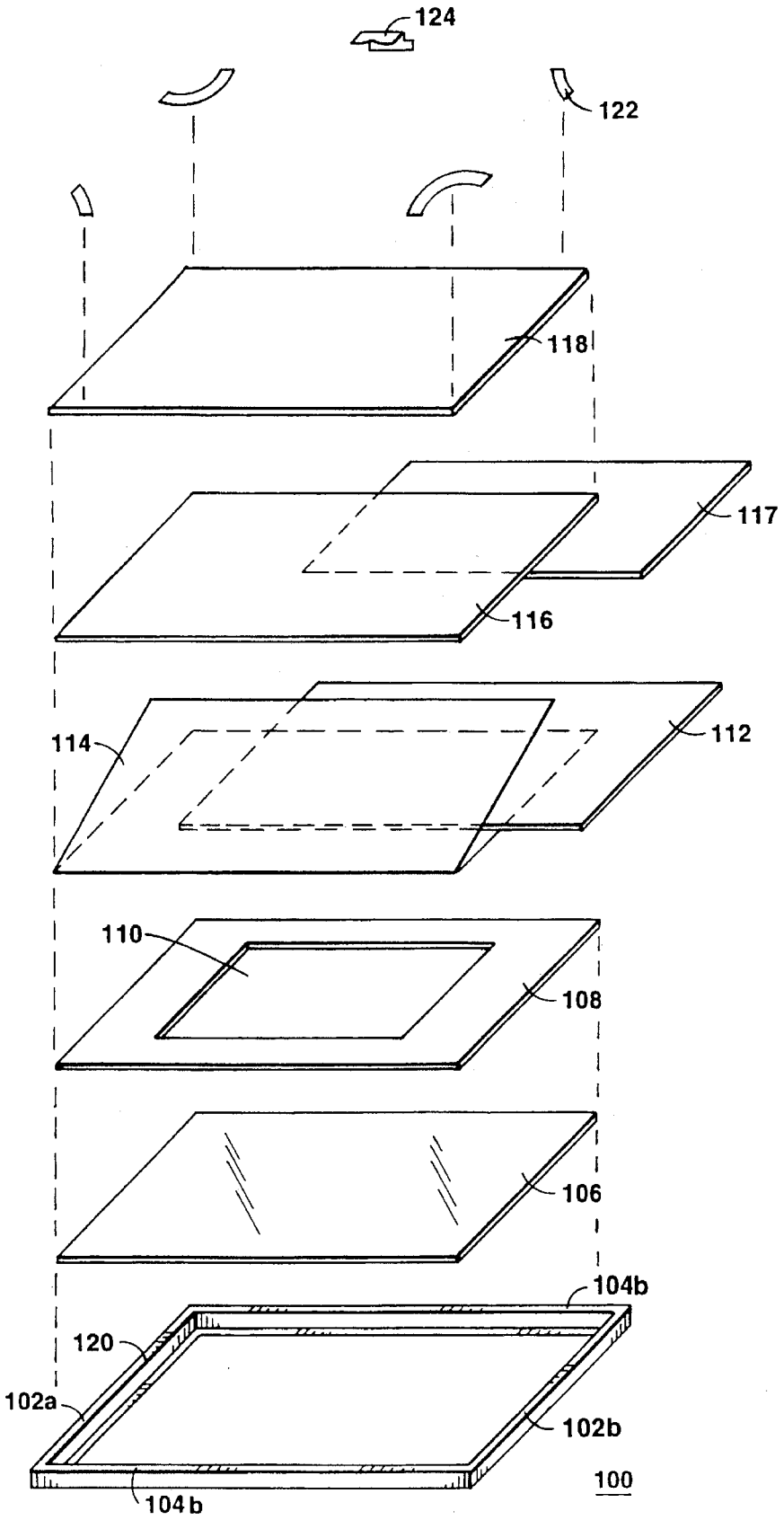
FIG. 3 is an exploded assembly drawing.

In order to best identify remaining elements of picture frame assembly 100 shown in FIG. 1 reference should be made to FIG. 2 in conjunction with FIG. 3. FIG. 2 is a cross sectional view of picture frame assembly 100 taken along line 2—2 in FIG. 1. FIG. 3 is an exploded assembly drawing of picture frame assembly 100. Parts shown in FIG. 2 and 3 are described in the order assembled in picture frame assembly 100.

Mat 108 is assembled against transparent plate 106. Mat 108 is conventionally made of ⅛th inch thick mat board. However, a preferred embodiment uses mat 108 composed of archival quality acid-free material. Again, a focus of the present invention is preservation and protection of artwork 112. Typically, mat 108 is pre-cut to form window 110. Window 110 provides requisite viewing area for display of artwork 112. Mat 108 is readily available in a variety of colors, selected to appropriately accent display of artwork 112. Unlike conventional methods, in the present invention, artwork 112 is not permanently mounted to mat 108. The unique combination of materials eliminates need for permanent mounting. A fundamental feature and inherent advantage of the present invention is the repeated use of mat 108 for different displays, or an easy change of mat 108 for a different color accent.

The method that eliminates need for individual mounting of artwork 112 to mat 108 is introduction of a sheet of foldover MYLAR, generically transparent plastic 114. Foldover MYLAR 114, or similar substance with equivalent flexibility and transparency, functions as a retainer to display artwork 112 through window 110. As shown in the exploded assembly drawing in FIG. 3, foldover MYLAR 114 uniformly encases artwork 112 in a sleeve-like fashion. In order to secure placement of artwork 112 within foldover MYLAR 114, static electricity may be used. Present mounting method may, for example, be employed by rubbing a household cloth on inner fold of foldover MYLAR 114, creating static electricity. In the present embodiment, foldover mylar 114 is sized to snugly fit dimensions of assembled frame legs 102*a*, 102*b*, 104*a*, 104*b* in picture frame assembly 100.

Figure 4:
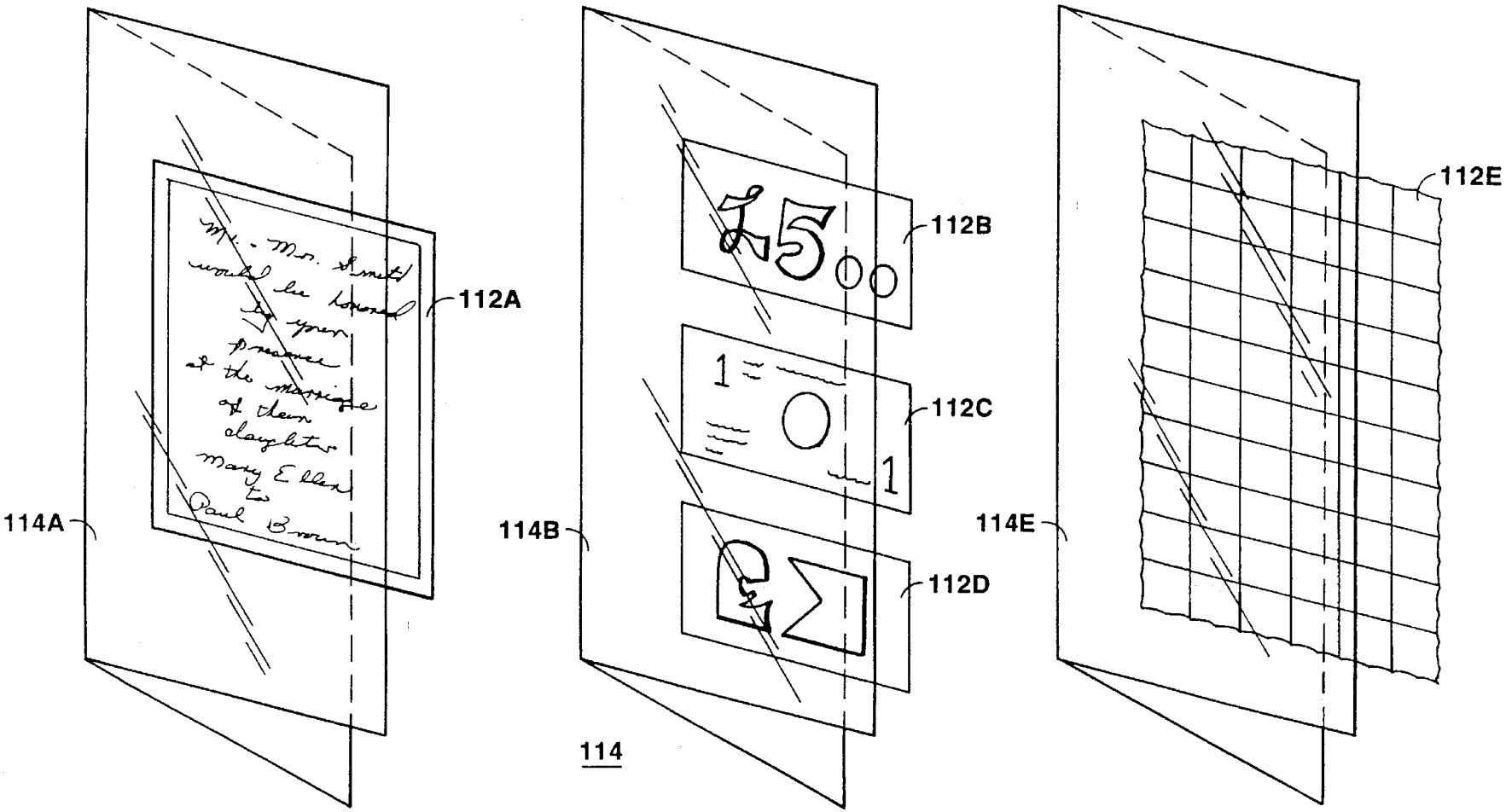
FIG. 4 is an exploded assembly drawing showing a retainer.

By using foldover MYLAR 114, not only is need for permanent mounting eliminated, but also need for tailor cutting mat 108 is not necessary. Use of foldover MYLAR 114 permits display of varying shaped, sized, and arranged artwork 112 in same picture frame assembly 100. By way of example, FIG. 4 illustrates the simplicity of mounting various materials with foldover MYLAR 114. FIG. 4 is an exploded assembly drawing showing a series of various sized and arranged collector's materials such as stamps, unusual monetary currency, and wedding invitations, shown ensleeved in foldover MYLAR 114. Wedding invitation 112*a* is ensleeved in foldover MYLAR 114*a*. Monetary currency 112*b*, 112*e*, 112*d* is ensleeved in foldover MYLAR 114*b*. Sheet of stamps 112*e* is ensleeved in foldover MYLAR 114*c*.

Not only does use of foldover MYLAR 114 simplify mounting of artwork 112, but such use obviates need for glues, pastes or adhesives. An inherent resulting advantage is prevention of exposure of artwork 112 to undesirable corrosive materials, chemicals, or acids, which may leach out of other mounting materials, papers, etc. Combination of foldover MYLAR 114 with use of transparent plate 106; thus provides maximum protection and preservation of artwork 112 from both corrosive materials and from ultraviolet light. Continuing with FIG. 3, the next layer in picture frame assembly 100 is decorative sheet 116. Decorative sheet 116 provides background for artwork 112 as viewed through window 110. Decorative sheet 116 is typically a sheet of construction paper, art paper, or material of similar thickness. Again, preferred embodiment uses a decorative sheet 116 composed of archival quality acid-free material. Since decorative sheet 116 is available in a variety of colors, selection of complimentary colors for mat 108 and decorative sheet 116 can accent artwork 112. Functionally, decorative sheet 116 can also serve to "color in" background area for smaller dimension artwork 112, such as unusual monetary currency 112*b*, 112*c*, 112*d* shown in FIG. 4.

An additional component of the mounting method of the present invention is use of pressure board 117. Pressure board 117 is assembled behind decorative sheet 116 in picture frame assembly 100. Pressure board 117 cooperates with foldover MYLAR 114 to provide a novel feature of the present invention. Pressure board 117 operates to secure placement of artwork 112 in picture frame assembly 100. Pressure board 117 is centered behind decorative sheet 116 so as to apply uniform pressure to compress decorative sheet 116, foldover MYLAR 114, and mat 108 against transparent plate 106. Thus positioned, pressure board 117 sandwiches layers of picture frame assembly 100 into a unique permanent mounting assembly, in contrast with former techniques employing other permanent mounting.

The final layer in picture frame assembly 100 shown in FIG. 3 is backing board 118. Backing board 118 is typically composed of paper board, styrofoam or laminated foam board, sized to snugly fit in picture frame assembly 100. Thus backing board 118 uniformly engages assembled frame legs 102*a*, 102*b*, 104*a*, 104*b* in picture frame assembly 100. Backing board 118 also functions as a protective closure to picture frame assembly 100.

Figure 5:
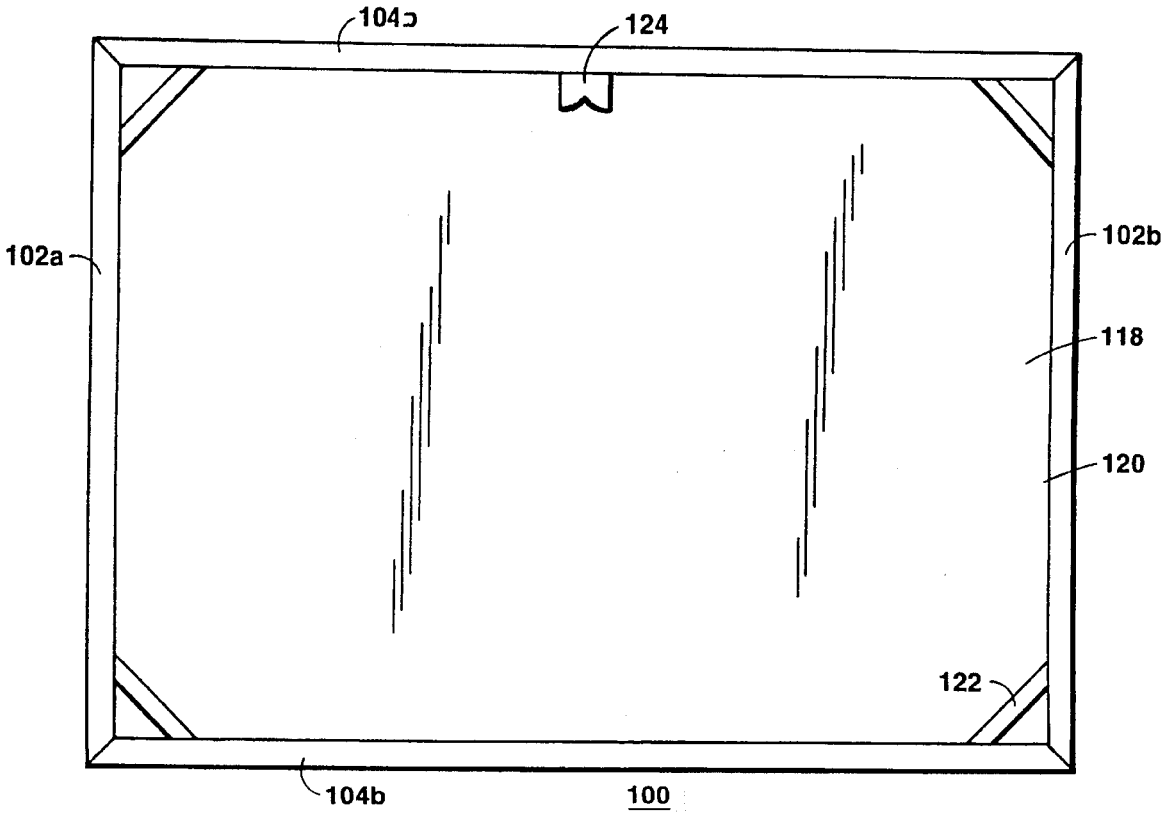
FIG. 5 is a rear view of a picture frame assembly.
Figure 6A:
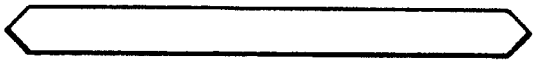
FIG. 6A and FIG. 6B are views of a retainer clip.
Figure 6B:
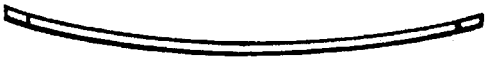

Assembled layers of picture frame assembly 100 are secured in place by retainer clips 122. FIG. 5 is a rear view of picture frame assembly 100. Retainer clips 122 have manufactured convex curvature. FIG. 6*a* is a top view of retainer clip 122, and FIG. 6*b* is a side view of retainer clip 122. Curvature provides requisites resistant pressure to secure placement of retainer clips 122. Curvature enables snapping each end of retainer clip 122 under back lip 120, shown in FIG. 3, of frame leg 102*a*, 102*b*, 104*a*, 104*b*. For example, retainer clip 122 is snapped under back lip 120 of frame leg 102*a* and then engaged at approximately a 45 degree angle under back lip 120 of frame left 104*a*. Arrangement of four retainer clips on back of picture frame assembly 100 is shown in FIG. 5.

Various means for preparation of picture frame assembly 100 for wall display maybe used. For example, a hanger clip 124 may be used. As shown in FIG. 5, hangar clip 124 is snapped under back lip 120, in centered position along frame leg 104*a*.

Second Exemplary Embodiment

Figure 7:
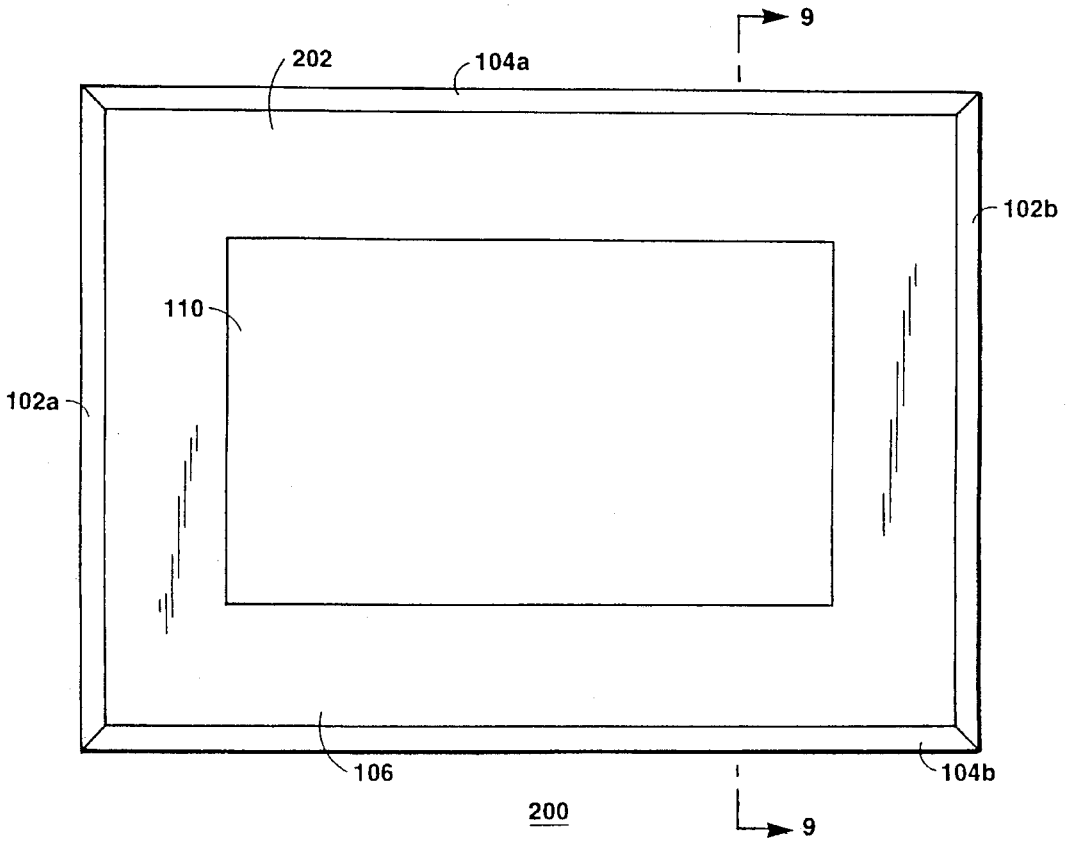
FIG. 7 is a front view of a display frame.

FIG. 7 shows a front view of a second exemplary embodiment of the invention, picture frame assembly 200. In the second exemplary embodiment shown in FIGS. 7, 8, 9, 10, and 11, mat 202 and backing board 206 are used. An alternative construction and means for mounting is employed with mat 202 and backing board 206, described in detail below. Where like parts from previous embodiment are shown in the figures, like reference numbers are used. Where new parts are introduced in present embodiment, new reference numbers are used.

Figure 9:
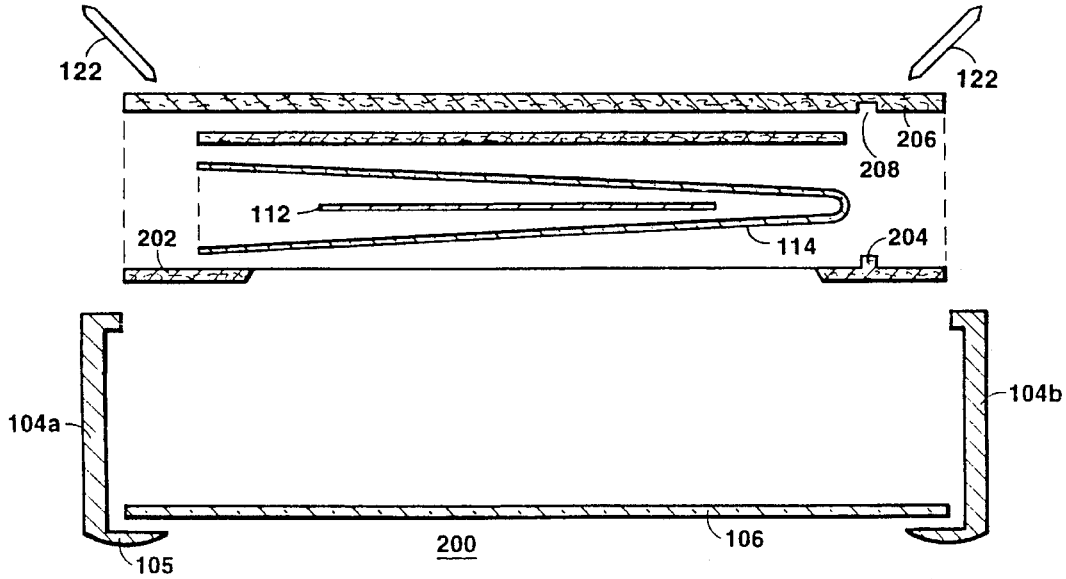
FIG. 9 is a cross sectional view of the picture frame assembly.
Figure 8:
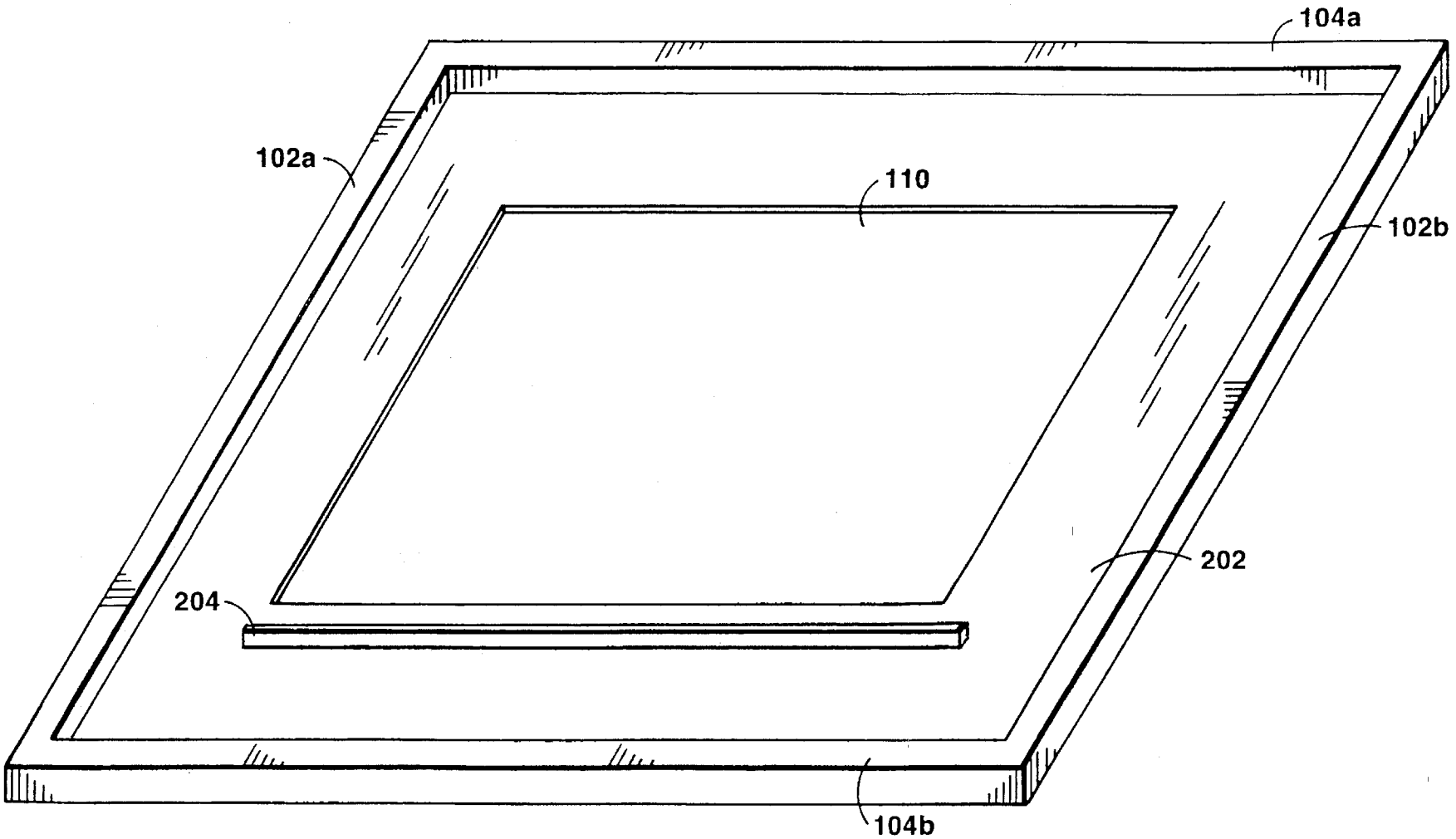
FIG. 8 is an isometric view of a mat having a groove formed therein.
Figure 10:
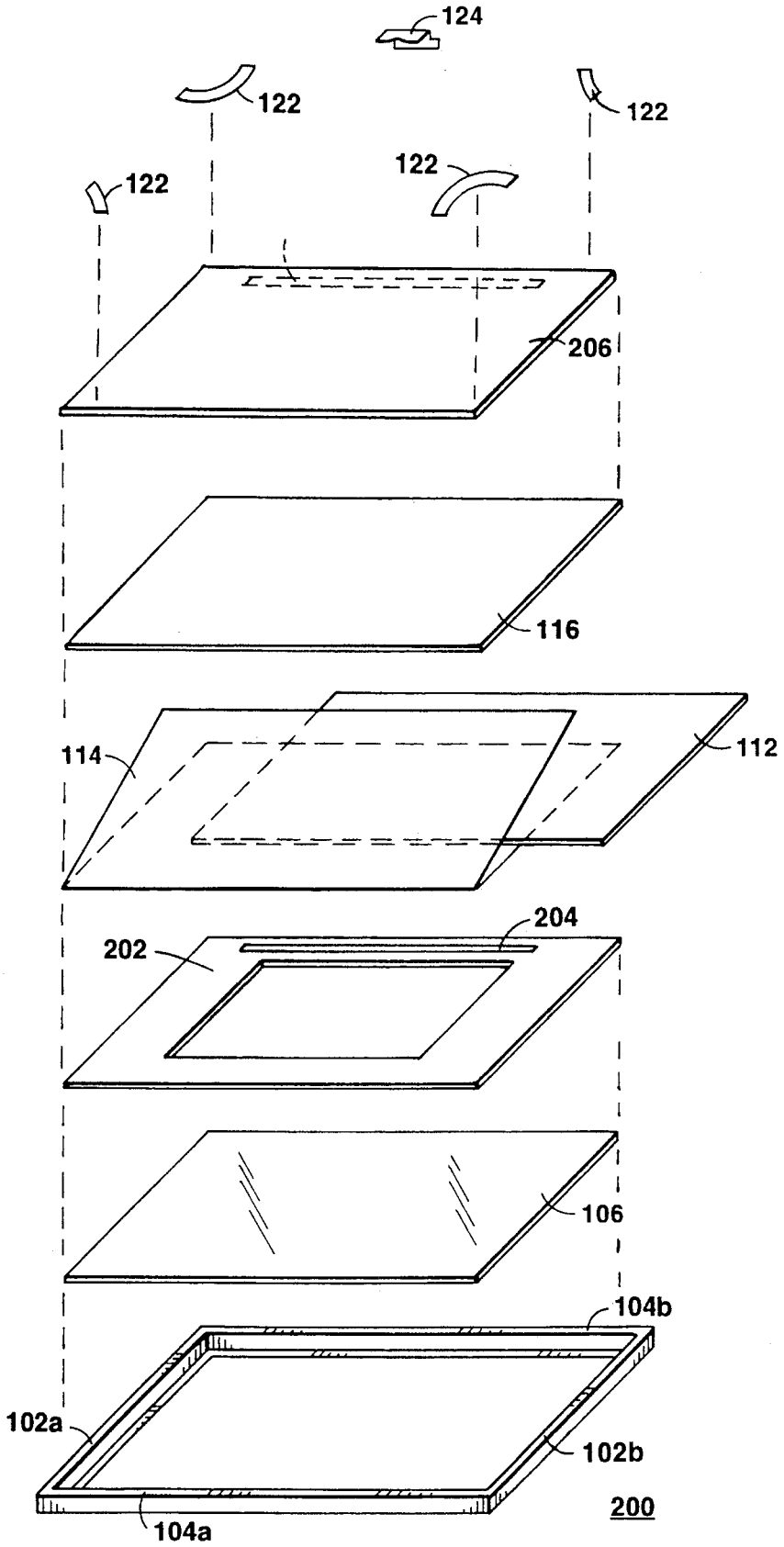
FIG. 10 is an exploded assembly drawing of a picture frame assembly using folded transparent material as a retainer.

Mat 202 is a mat board, and for example, is composed of acid free ⅛th inch thick mat board. FIG. 8 is a an isometric view of mat 202. FIG. 9 is a cross sectional view of picture frame assembly 200 taken along line 9—9 shown in FIG. 7. FIG. 10 is an exploded assembly drawing of picture frame assembly 200. As shown in FIG. 8, the present embodiment uses mat 202 constructed with shelf 204. Shelf 204 is attached to backside of mat 202. As shown in FIG. 8, for example, position of shelf 204 is parallel to frame leg 104*a*. Selection of shelf position is dependent on display of artwork 112.

In contrast to the layered pressure assembly described in the first embodiment, the present embodiment employs shelf 204 on mat 202 as an alternative mounting method to suspend artwork 112. Artwork 112 is again uniformly encased by foldover MYLAR 114. In present embodiment foldover MYLAR 114 is sized to engage, for example, assembled frame legs 102*a*, 102*b*, 104*a*. Foldover MYLAR 114 does not engage frame leg 104*b*, but instead rests against shelf 204. Shelf 204 functions to receive and suspend placement of foldover MYLAR 114 with artwork 112. Decorative sheet 116 is used and also sized to be visible through window 110 of mat 202 in picture frame assembly 200.

Figure 11:
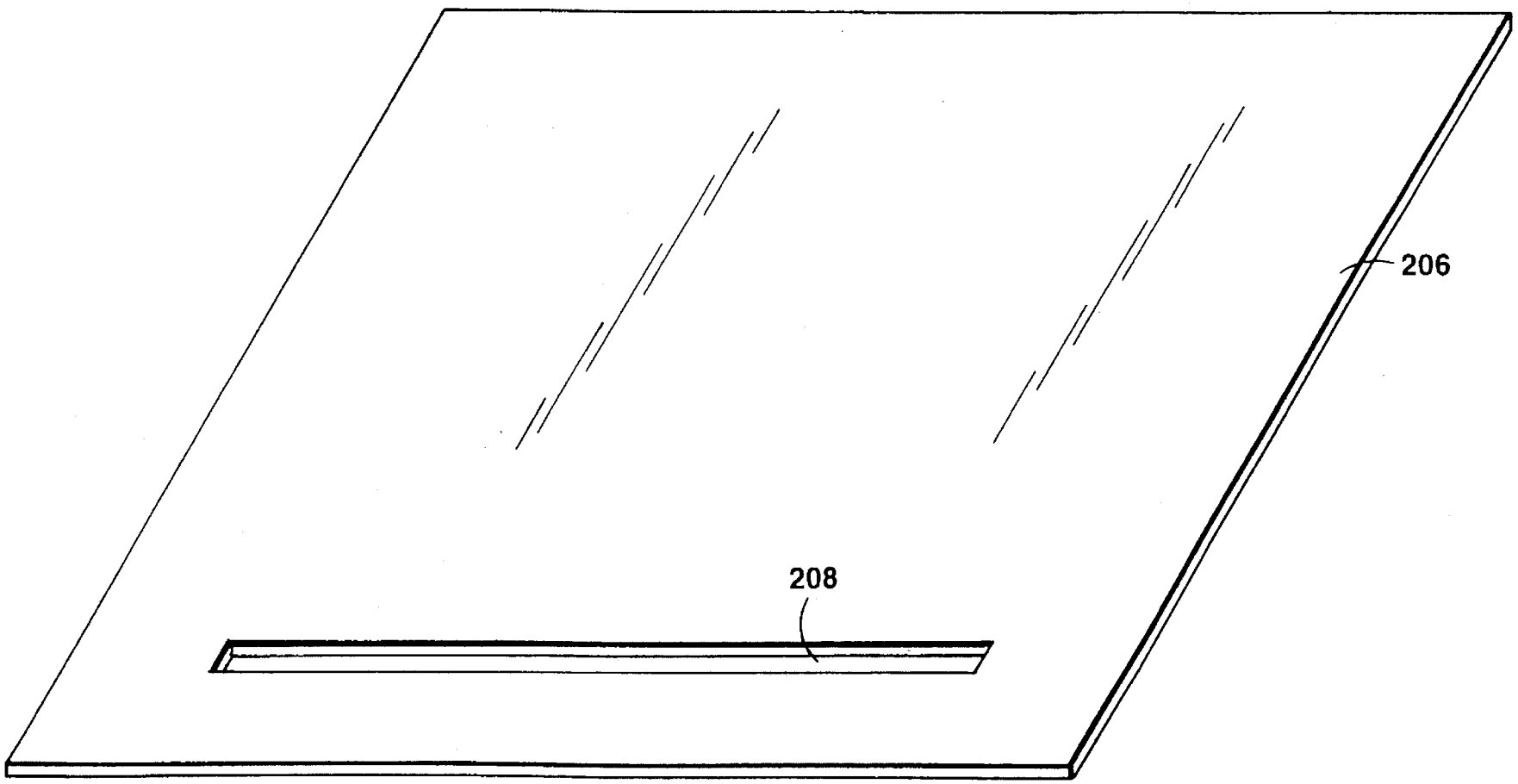
FIG. 11 is an isometric view of a backing board having a groove formed therein.
Figure 12E:
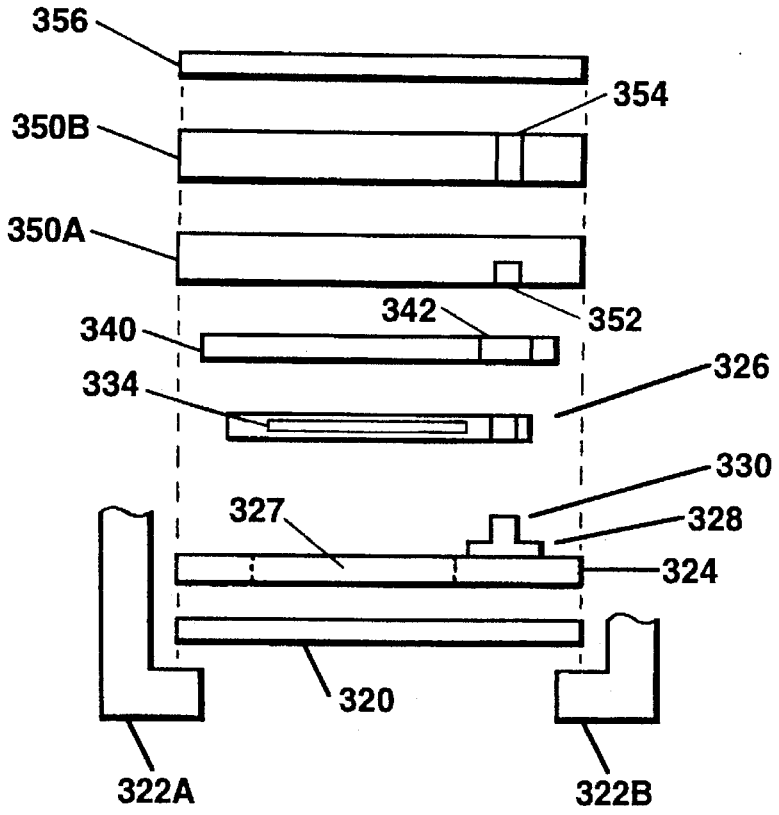

This second embodiment of the invention uses backing board 206 constructed with groove 208, shown in FIG. 11. Backing board 206 is typically composed of paper board styrofoam or laminated foam board, sized to snugly fit within assembled frame legs 102*a*, 102*b*, 104*a*, 104*b*. Groove 208 is formed on a side of backing board 206, facing shelf 204, such that shelf 204 fits into groove 208. The position of groove 208 on backing board 206 depends upon the position of shelf 204 on mat 202. When assembled, shelf 204 fits into groove 208 to securely support artwork 112 and foldover MYLAR 114 in picture frame assembly 200. Pressure from pressure board 117 may be used to compress foldover MYLAR 114 between mat 202 and backing board 206.

Figure 9A:
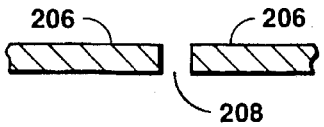
FIG. 9*a* is a cross sectional view of a backing board.

As an alternative embodiment, groove 208 may pass completely through backing board 206, as shown in FIG. 9*a*. FIG. 9*a* is a cross sectional view with the section cutting across groove 208.

Assembled layers of picture frame assembly 200 are secured in place by application of retainer clips 122. Arrangement of retainer clips on back of picture frame assembly 200 is shown as in FIG. 5. As with previous embodiment, hangar clip 124 may be used to enable wall display of picture frame assembly 200. Placement of hanger clip 124 is shown as in FIG. 5.

Third Exemplary Embodiment

Figure 12:
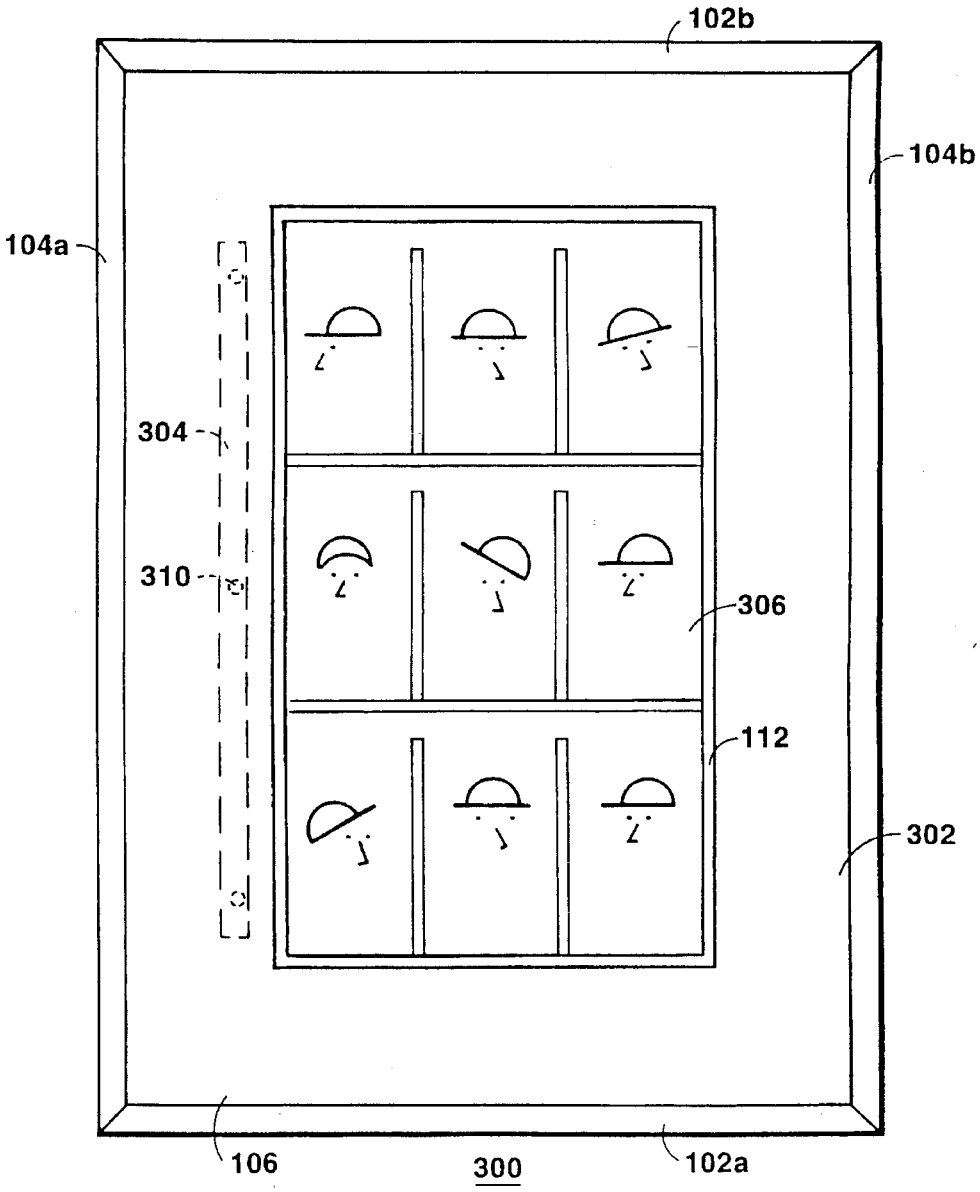
FIG. 12 is a front view of the picture frame assembly having a plurality of desired items mounted therein for display.

Referring now to FIG. 12, there is shown a front view of a third exemplary embodiment of the invention, picture frame assembly 300. In the third exemplary embodiment shown in FIG. 12 mat 302 is used for display of various album pages for collectors materials. FIG. 12, for example, displays an album page 306 of baseball cards. An alternative construction and means for mounting is employed with mat 302, shown in FIG. 13 and described in detail below. Where like parts from previous embodiment are shown in the figures, like reference numbers are used. Where new parts are introduced in present embodiment, new reference numbers are used.

Figure 13:
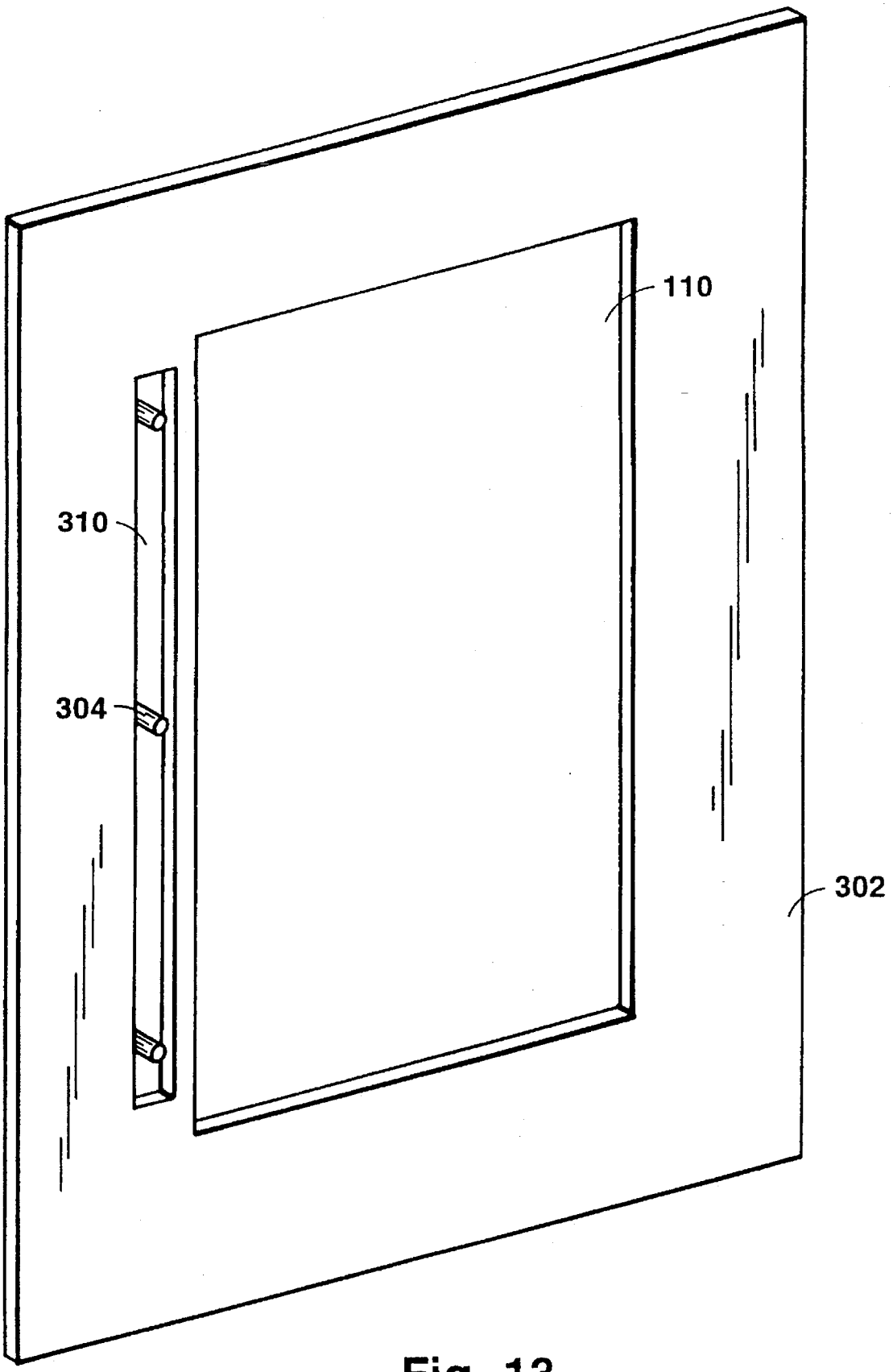
FIG. 13 is a rear view of a mat having pins mounted therein.
Figure 14:
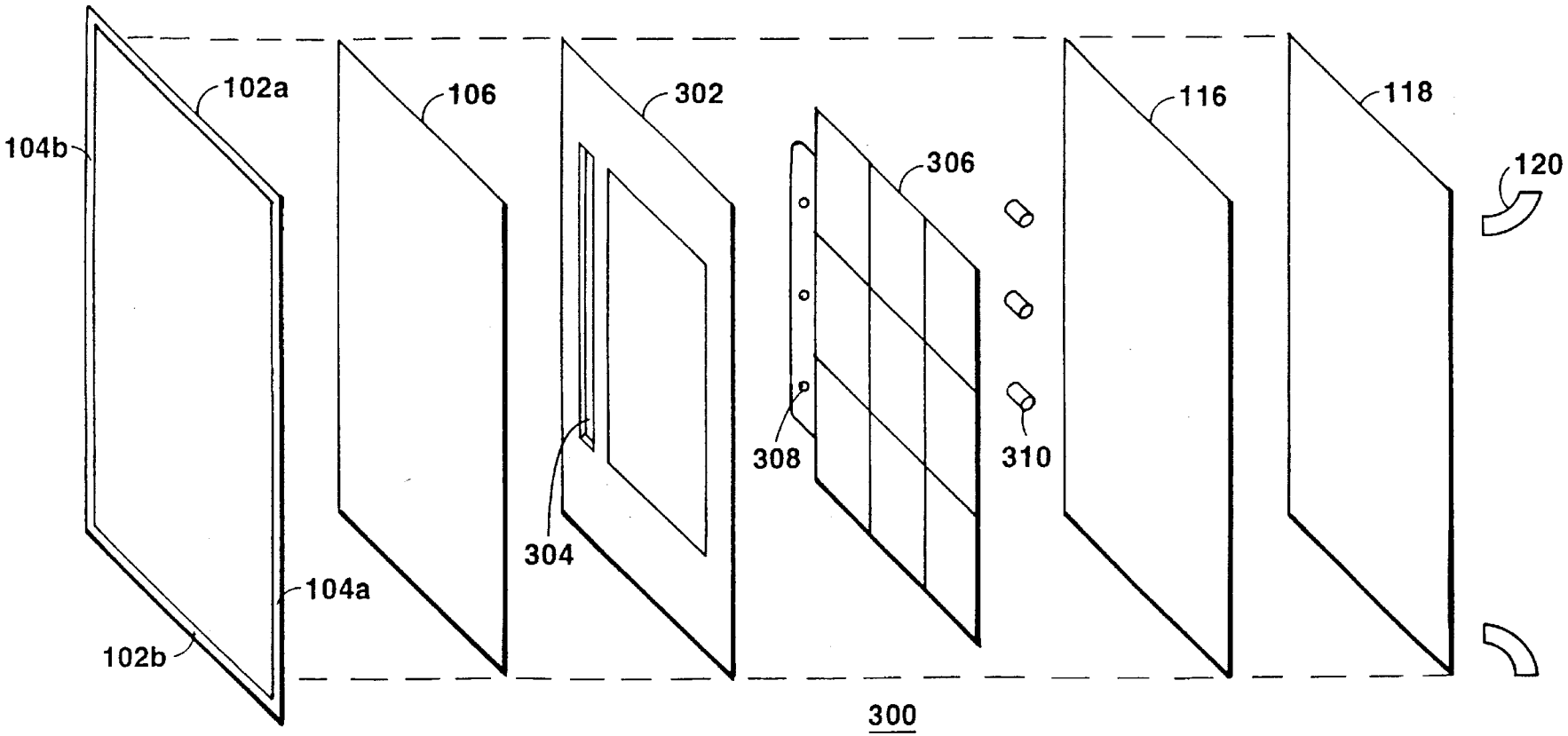
FIG. 14 is an exploded assembly view of a picture frame assembly having pins holding an album page in place.

As with previous embodiments, mat 302 is, for example, composed of acid free ⅛th inch thick mat board. FIG. 13 is a rear view of mat 302. FIG. 14 is an exploded assembly drawing of picture frame assembly 300. An exemplary embodiment uses mat 302 constructed with recessed trough 304. Trough 304 is a slot in mat 302. Position of trough 304 is parallel to frame leg 102*a* or 104*a*.

Trough 304 has pins 310 to mount artwork 112. The pins may, for example, be pegs. Many album pages have pre-existing punched holes. For example, where artwork 112 is an album page 306, pins 310 are placed through existing punched holes 308 of album page 306. FIG. 15 is an isometric view of an album page 306, with existing punched holes 308. Trough 304 receives pins 310 to secure mounting of artwork 112 in picture frame assembly 300. Decorative sheet 116 is sized to snugly fit assembled frame legs 102*a*, 102*b*, 104*a*, 104*b*. A backing board 118, as shown in FIG. 3 and from the first embodiment, may also be used in present embodiment. Backing board 118 is typically composed of paper board, styrofoam or laminated foam board, sized to snugly fit within assembled frame legs 102*a*, 102*b*, 104*a*, 104*b*.

Figure 15A:
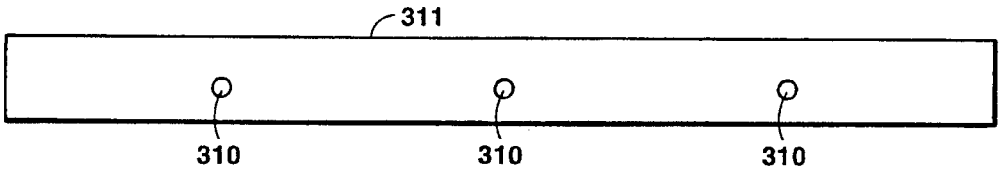
FIG. 15*a* and 15*b* are views of a pin strip.
Figure 15B:
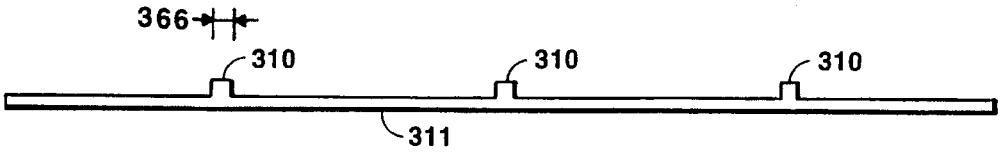

As an alternative, pins 310 may be attached to base 311, as shown in FIG. 15*a* and FIG. 15*b*. Pins 310 in base 311 may be, for example, inserted through existing holes 308 in album page 306, to secure placement in trough 304.

Assembled layers of picture frame assembly 300 are secured in place by application of retainer clips 122. Arrangement of retainer clips on back of picture frame assembly 300 may be as shown in FIG. 5. As with previous embodiment, hangar clip 124 may be used to enable wall display of picture frame assembly 300. Placement of hanger clip is as shown in FIG. 5.

Figure 15C:
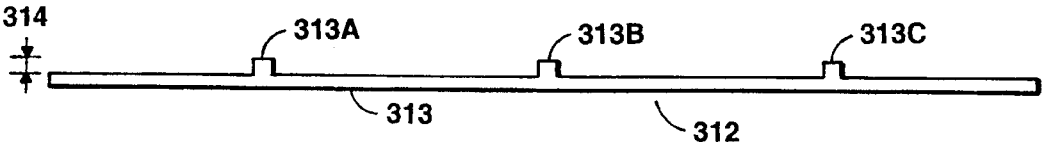
FIG. 15*c* is a side view of a pin strip.

In a preferred embodiment of the invention it was found suitable for pin 310 attached to base 311 shown in FIG. 15*b* to be formed as one whole structure, pin strip 312. In FIG. 15*c*, there is shown a cross section of pin strip 312, made, for example, out of plastic using an injection molding technique. Pin strip 312 has a base 313, pin 313*a*, pin 313*b*, and pin 313*c*. Pin strip 312, including base 313, and pins 313*a*, 313*b*, 313*c* may be made in a single molding process as a single plastic part. Alternatively, pin strip 312 may have only two pins, for example pin 313*a* and pin 313*c*. As a still further alternative, pin strip 312 may have only one pin, for example pin 313*b*.

Turning now to FIG. 15*d*, it is shown that pin strip 312 may be formed, for example, with one pin 312*c*, two plans 312*b*, or three pins 312*a*. Pin strip pins 312*a*, 312*b*, 312*c* are positioned to insert into an album page with corresponding holes formed therein, Pin strip 312 is retained in place, by for example, being inserted into a groove or holes in a mat, by being glued to a mat, or otherwise attached to a mat. In one preferred embodiment, the pins may extend into holes or a slot in a backing board. Alternatively, pin strip 312 may be attached to a backing board. In a still further embodiment of the invention, length 314 of pins 312*a*, 312*b*, 312*c*, 313*a*, 313*b*, 313*c* may sufficiently short that they only extend through the album page, and need not fit into a recess of a backing board.

In a preferred embodiment, pin strip 312 may have pins inserted through an album page, and the pin strip and album page held in place relative to the backing board by the pins fitting into holes in the backing board.

As shown in FIG. 15*d*, glass 320 is at the front of the assembly. The mat is shown in alternative embodiments as mat 324*a*, 324*b*, 324*c*. The mat has opening 327*a*, 327*b*, 327*c* for display of artwork 334 (FIG. 15*e*) retained in album page 326. Mat 324*a* has a pin strip 312*a* having three pins. Mat 324*b* has a pin strip 312*b* having two pins. Mat 324*c* has a pin strip 312*c* having one pin. Two alternative embodiments of the album page 326*a*, 326*b* are shown. Alternative album page 326*a* has three holes to accommodate the three pins of pin strip 312*a*. Alternative album page 326*b* has two holes to accommodate the two pins of pin strip 312*b*.

An optional decorative sheet 342 is shown. Decorative sheet 342 may, for example, have holes formed therein to accept pins from the pin strip, or may simply have a slot 343 to fit over the pins.

Two alternative backing board designs are shown, backing board alternative 351*a* has three holes 353*a* to accept the three pins 312*a*. Backing board alternative 351*b* has a slot 353*b* to accept the pins. Still further alternative arrangements to accommodate pins of pin strip 312 in a backing board may be used to practice the invention.

Turning now to FIG. 15*e*, there is shown a cross section of an assembled display apparatus. Glass 320 fits into a picture frame 322A 322B. Mat 324 fits against glass 320, and mat 324 has opening 327 for display of album page 326. Pin strip 328, for example constructed as pin strip 312, has pins 330. Pins 330 fit into holes 332 formed in album page 326. Album page 326 contains artwork 334, and it is desired to exhibit artwork 334.

Decorative sheet 340 may optionally included in the assembly in order to provide, for example, a colored, or otherwise desirable background behind artwork 334. Decorative sheet 340 has holes 342 to accept pins 330, so that pins 330 hold decorative sheet 340 in place.

In a preferred embodiment of the invention, pin strip 328 holds album page 326 in place by having pins 330 pass through holes in album page 326, and by the pins 330 being inserted into mating holes in the backing sheet.

Two alternative backing sheets 350A and 350B are shown in FIG. 15*e*. Backing sheet alternative 350A has a hole or groove 352 formed therein to accept pins 330, where hole or groove 352 does not penetrate through backing sheet 350A. Backing sheet alternative 350B has holes 354 to accept pins 330, where holes 354 penetrate through backing sheet 354. Holes 354 are shown in FIG. 15*d* as holes 353*a*, 353*b*, 353*c*. The choice of the alternative style of backing board illustrated as alternative 350A or alternative 350B is determined by factors such as the length 314 of the pins 330, the thickness of the artwork 334 and album page 326, the thickness of decorative sheet 340, the composition of the backing board, etc.

As shown in FIG. 15*e*, final backing board 356 may be used to provide a smooth surface at the back of the assembly when it is assembled in picture frame 322A 322B. Final backing board 356 is particularly useful in the event that backing board alternative 350B is used, and consequently pins 330 are visible through holes 354 in backing board 350B. In an embodiment of the invention, the length 314 of pins 330 is chosen so that pins 330 do not protrude through holes 354 of backing board 350B, and in this embodiment final backing board 356 is useful in providing a smooth surface at the back of the picture frame assembly.

Figure 15F:
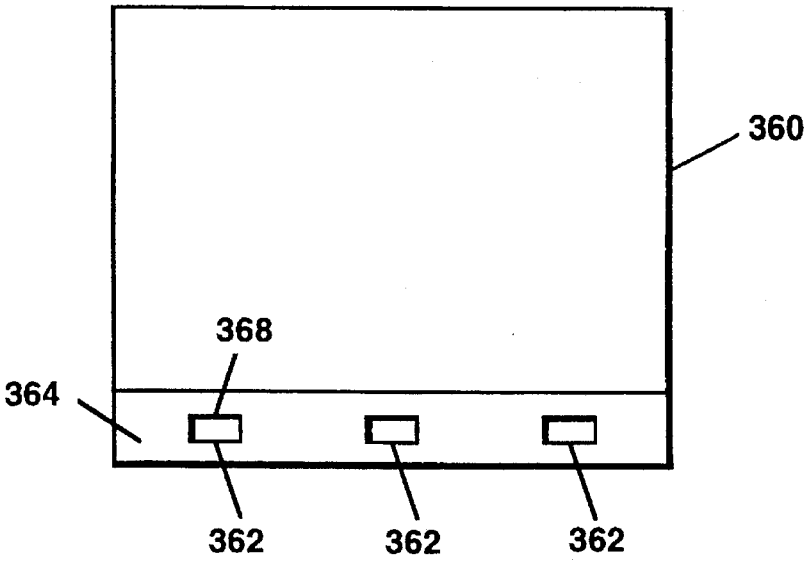
FIG. 15*f* is an album page having elongated holes.
Figure 15:
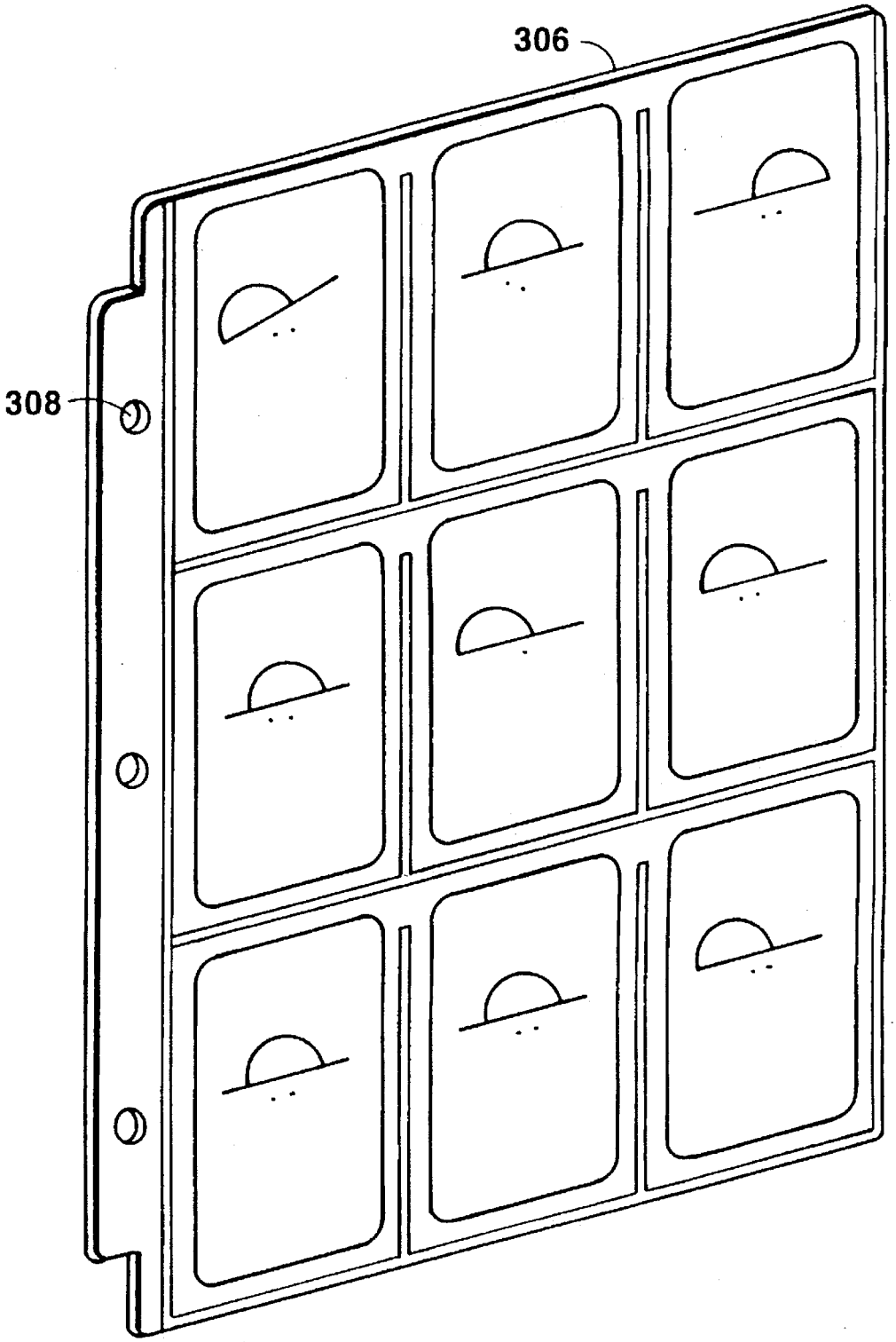
FIG. 15 is an isometric view of display materials in an album page having holes formed along an edge.

Turning now to FIG. 15*f* there is shown album page 360 having elongated holes 362. Elongated holes 362 have a short dimension 364 substantially equal to a diameter 366 of pins 310 (FIG. 15*b*). Elongated holes 362 have a long dimension 368 substantially greater than the diameter 366 of pins 310. Manufacturing variations may cause random variations in spacing of holes 362, and manufacturing variations may cause random variations in spacing of pins 310. The long dimension 368 of holes 362 compensates for this manufacturing variation in hole spacing or in pin spacing.

Figure 15G:
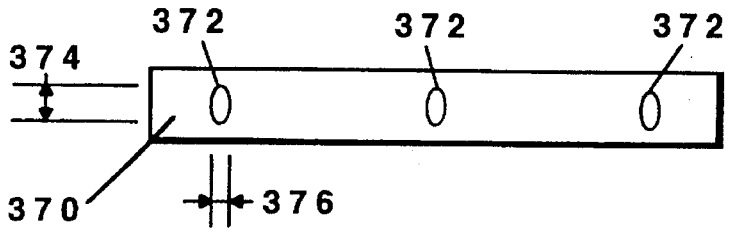
FIG. 15*g* is a pin strip having oval pins.

Turning now to FIG. 15*g*, there is shown pin strip 370 having oval pins 372. Each oval pin 372 has a long axis 374. Each oval pin 372 has a short axis 376. Long axis 374 is chosen to fit into a hole in a standard album page. Short axis 376 is chosen to compensate for manufacturing variations in pin spacing, and compensate for manufacturing variations in hole spacing in album pages.

Manufacturing variations in pin spacing and hole spacing may occur for a number of manufacturing reasons. For example, a pin strip 370 may be made of a plastic material formed in, for example, a plastic molding machine. The dimensions of a plastic part may change after removal from the machine, and the amount of dimensional change may depend on a number of factors such as temperature of operation of the molding machine, composition of the plastic, etc. Also, album pages are often formed out of plastic, and the plastic of album pages may have dimensional changes after formation of the page. The elongated holes in the album page shown in FIG. 15*f*, and the oval shaped pins shown in FIG. 15*g* are sized to compensate for ordinary variations in manufacturing.

Figure 15H:
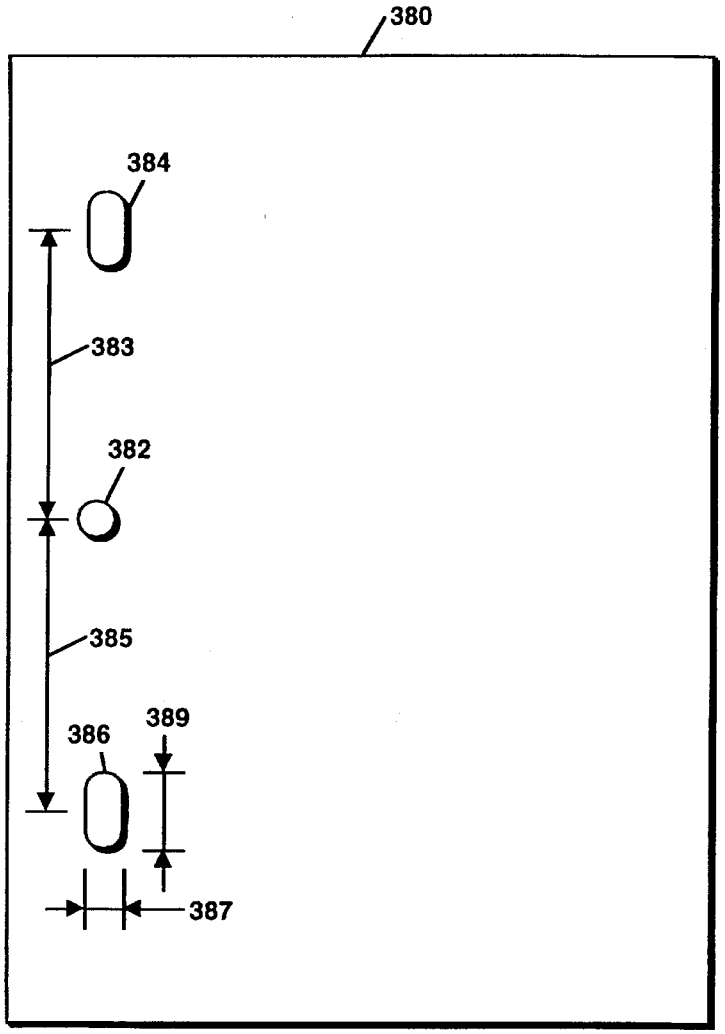
FIG. 15*h* is a view of a backing sheet

Turning now to FIG. 15*h*, there is shown backing board 380. Backing board 380 has center hole 382. Center hole 382 is circular, and has a diameter matched to the diameter of middle pin 313*b* of pin strip 312, as shown in FIG. 15*c*, Backing board 380 also has oval hole 384 and oval hole 386. Holes 382, 384, 386 may, for example, pass completely through backing board 380. Spacing of hole 382 and oval hole 384, shown by arrow 383, is adjusted to the nominal spacing of pins 313*a* and 313*b*, and this spacing is selected to agree with standard hole spacing of album pages. The oval shape of hole 384, having along axis along the line joining hole 384 and hole 382, compensates for manufacturing variation in production of pin strip 312, backing sheet 15*h*, and album pages. That is, the elongated shape of oval hole 384 compensates for small variations in pin spacing in manufacture of a pin strip, and also compensates for small manufacturing variations in manufacture of album pages. Likewise, the oval shape or hole 386 compensates for manufacturing variation in spacing of holes 382 and 386, as shown by arrow 385, and in spacing of the corresponding pins of pin strip 312.

The size of oval holes 384 and 386 is chosen so that the short dimension 387 just accepts a cylindrical pin. A diameter of ¼ inch for a cylindrical pin is a standard size which fits many commercially available album pages. The long dimension 389 is typically chosen to be equal to ½ or 2 times the value of the dimension 387, and so is typically chosen to be ⅜ inch to approximately ½ inch for a ¼ inch pin.

Fourth Exemplary Embodiment

Figure 16:
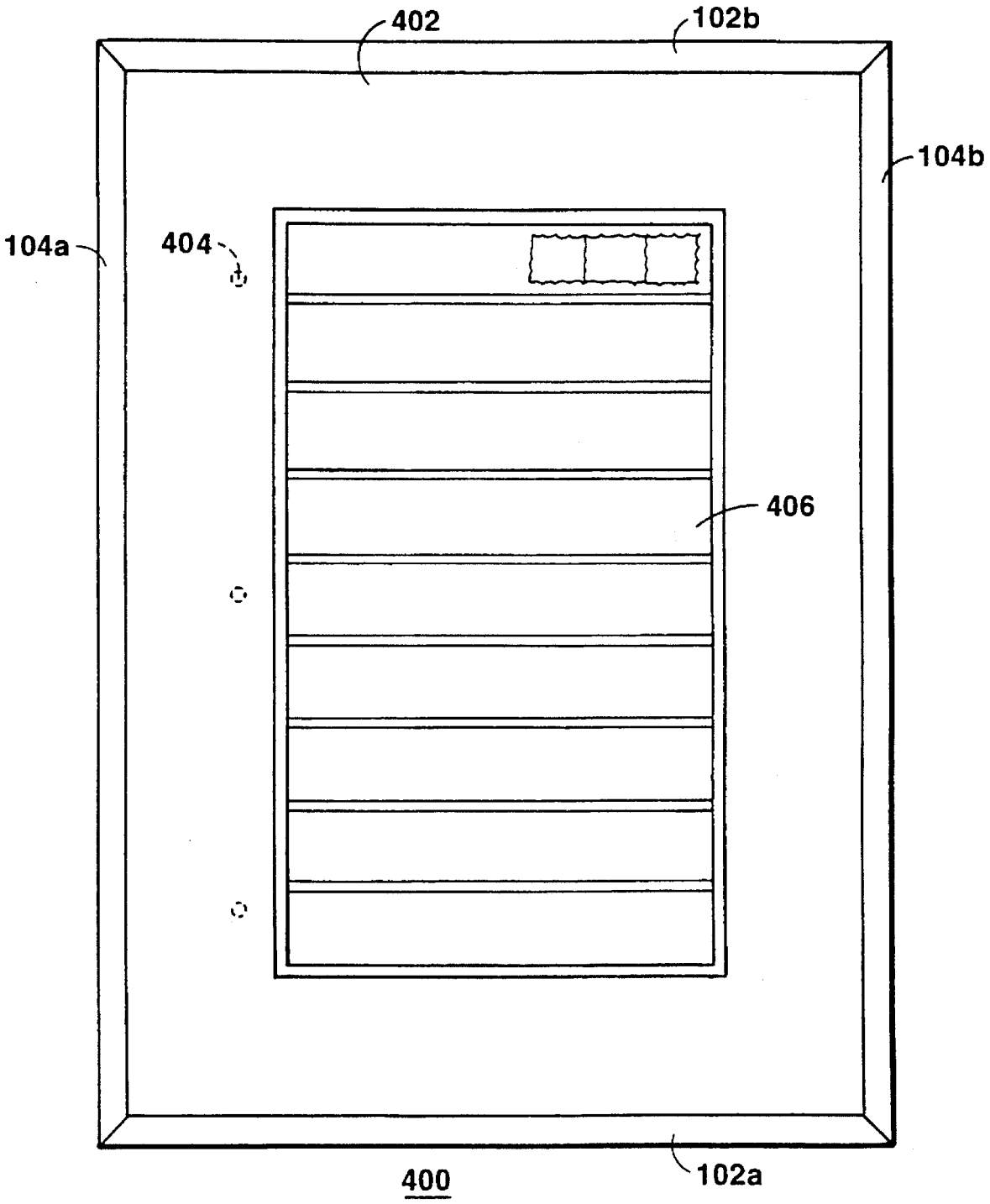
FIG. 16 is a front view of the picture frame assembly having small desired items mounted in pockets formed in an album page.

Referring now to FIG. 16, there is shown a front view of a fourth exemplary embodiment of the invention, picture frame assembly 400. FIG. 16 is a front view of the picture frame assembly having small desired items mounted in pockets formed in an album page 406. In FIG. 16, mat 402 is used. Mat 402 is used for display of various album pages from collectors materials. FIG. 16, for example, displays an album page 406 of stamps. An alternate construction and means for mounting is employed with mat 402, described in detail below. Where like parts from previous embodiment are shown in the figures, like reference numbers are used. Where new parts are introduced in present embodiment, new reference numbers are used.

Figure 19A:
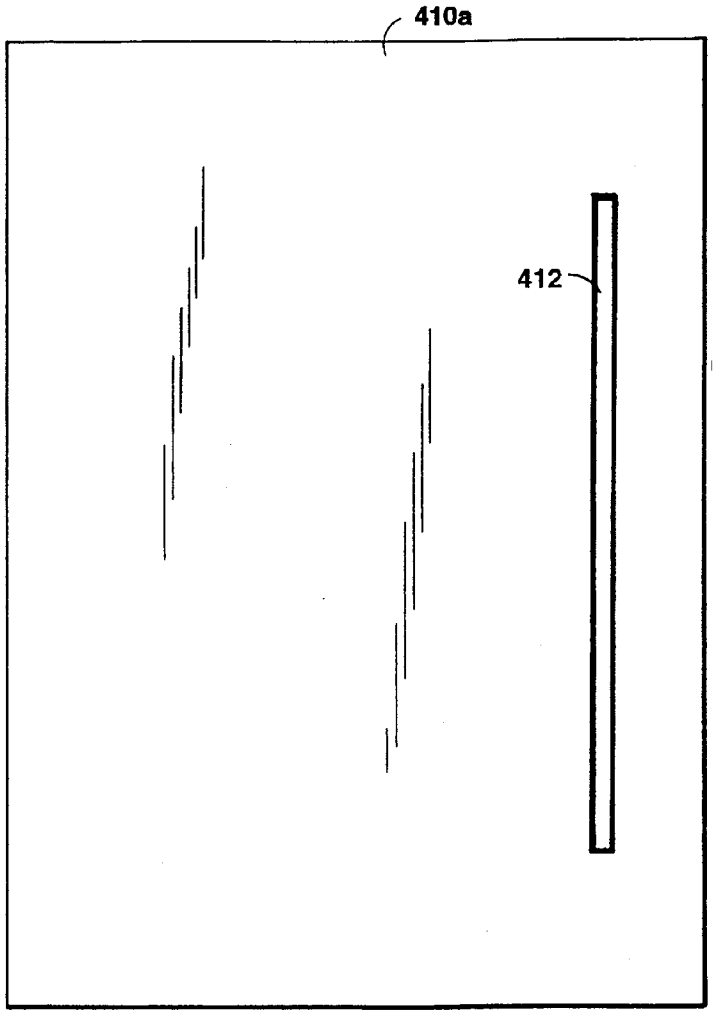
FIG. 19*a* is a front view of a backing board having a groove formed therein for support of pins.
Figure 17:
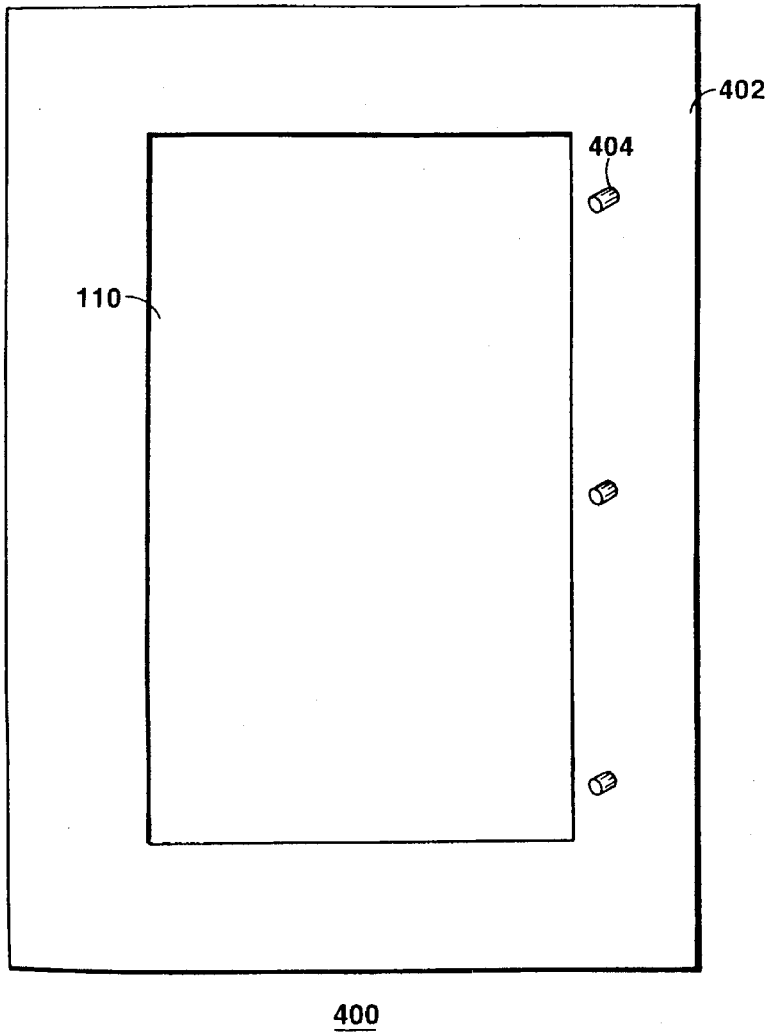
FIG. 17 is a rear view of a mat having pins attached thereto.
Figure 18:
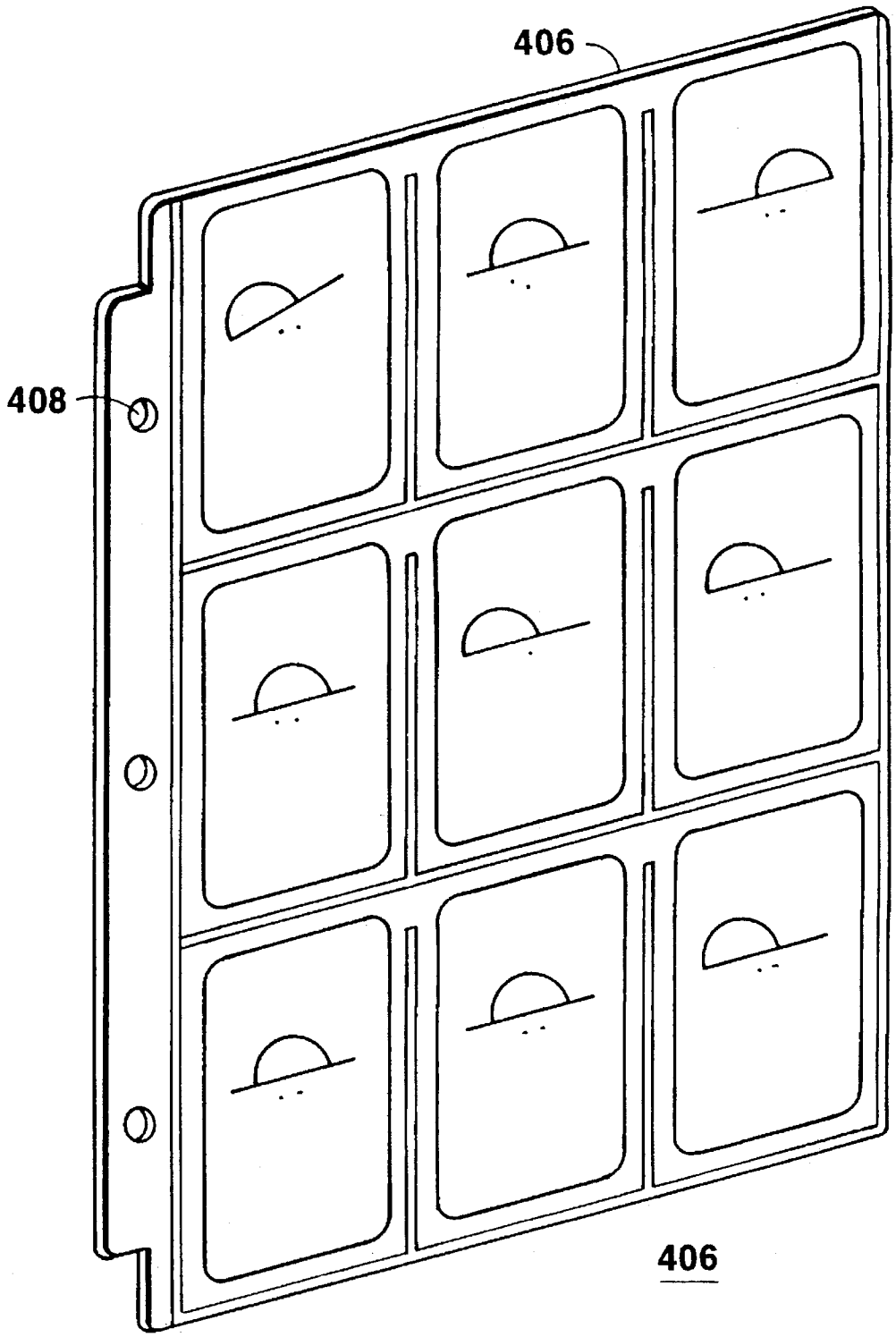
FIG. 18 is an isometric view of display materials in an a page having holes formed along an edge.
Figure 19B:
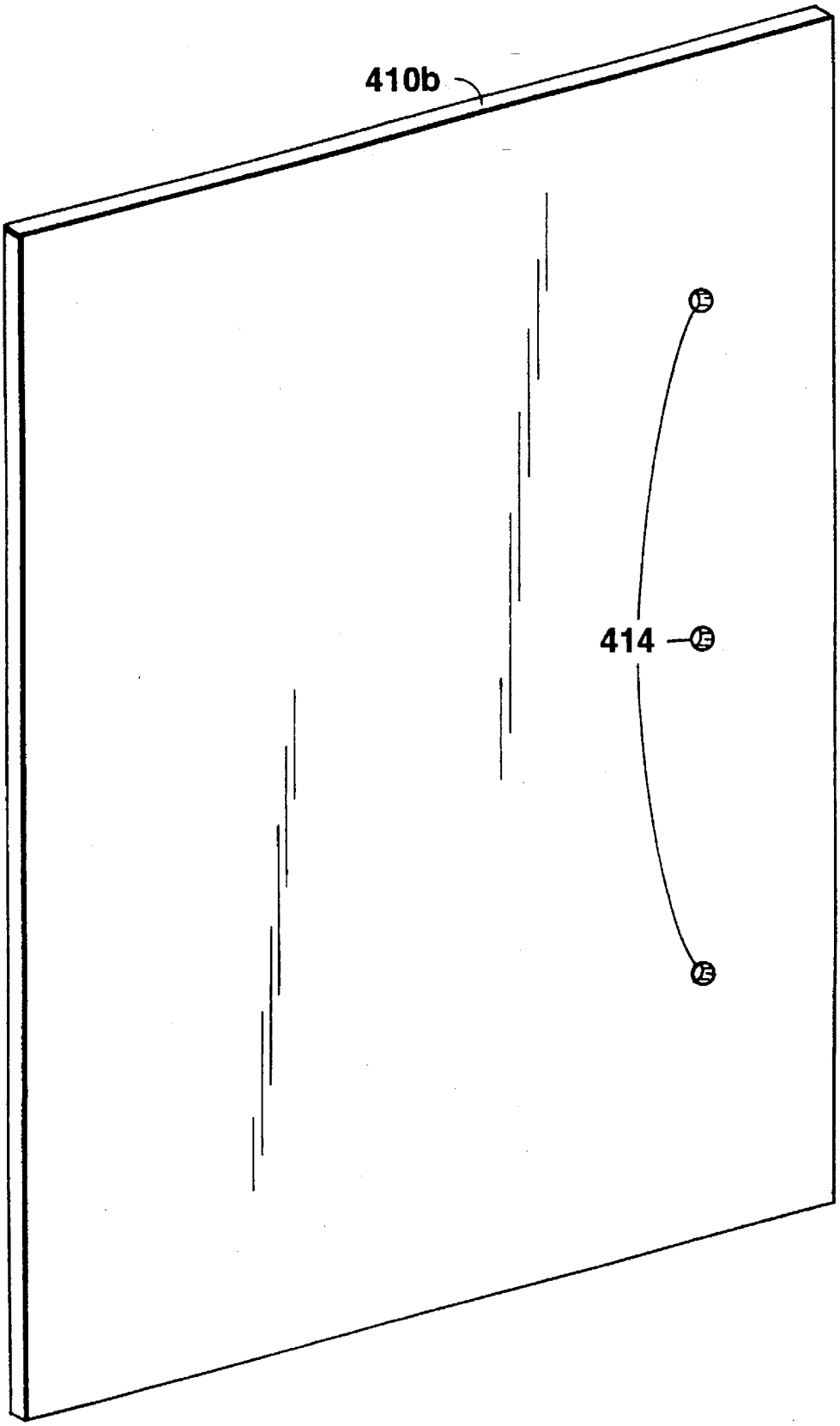
FIG. 19*b* is a front view of a backing board having holes formed therein for support of pins.
Figure 20:
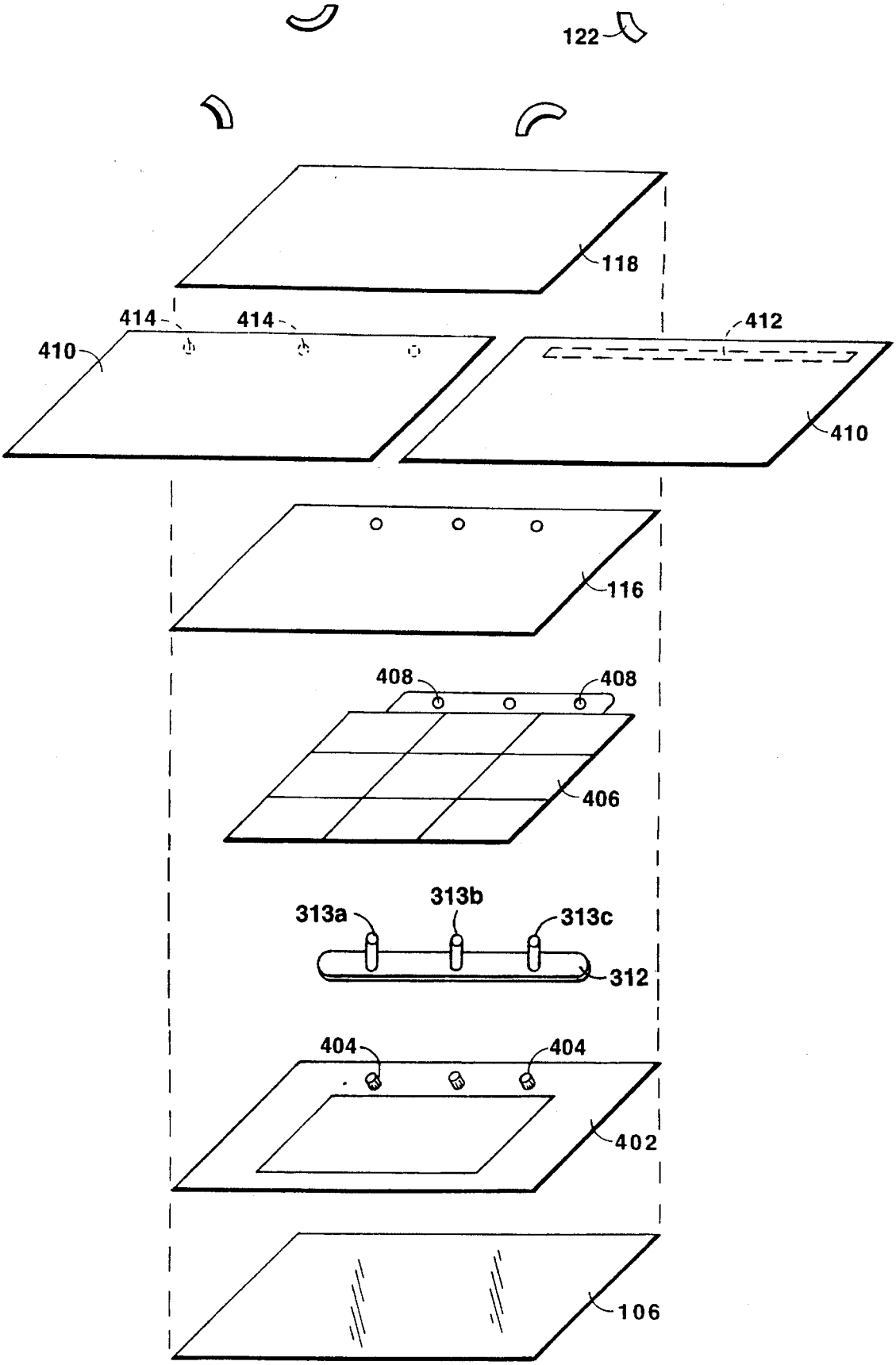
FIG. 20 is an exploded assembly drawing having displayed materials held in place by pins in either a groove or holes in a backing board.

In contrast to previous embodiments, present embodiment employs pins 404 attached to mat 402, as shown in FIG. 17. For example, pins 404 may be attached to mat 402 by glue or some other suitable adhesive. Many album pages have pre-existing punched holes. For example, in FIG. 18, where artwork 112 is an album page 406, pins 404 are placed through pre-existing punched holes 408 in album page 406. FIG. 18 is an isometric view of an album page 408. FIG. 19*a* shows backing board 410A with groove 412. FIG. 19*b* shows backing board 410B with holes 414. For example, pins 404 are inserted in groove 412 in backing board 410A to secure placement of album page 406 in picture frame assembly 400. As an alternative, pins 404 are inserted in holes 414 in backing board 410B to secure placement of album page 406. FIG. 20 is an exploded assembly drawing having an album page 406 held in place by pins 404 in either groove 412 or holes 414.

As alternative embodiments, there may be used either one pin, or two pins, or three pins 404.

As an alternative, there is shown in FIG. 20 pin strip 312. Pins 313*a*, 313*b*, 313*c* of pin strip 312 may be used to secure album page 406. In the alternative embodiment employing pin strip 312, mat 402 is simply a smooth mat board, and does not have pins 404 attached thereto (not shown in FIG. 20).

In an embodiment of the invention it was found suitable to make pins 404 from a ¼ wood dowel, and to insert the pins into a ¼ inch hole drilled in backing board 410. Wooden pins 404 cut from a ¼ inch dowel and having a length of between ¼ inch and ½ inch were found to satisfactorily hold in place an album page with pockets. The pockets are suitable for baseball cards or suitable for monetary currency, etc., so as to display several desired items in a picture frame.

In a preferred embodiment of the invention, it was round convenient to use pin strip 312 to hold album page 406 in place. As shown in FIG. 20, pin strip 312 is a single plastic piece having pin alternatives 313*a*, 313*b*, or 313*c*. The pins fit into holes such as holes 414 to secure the album page to backing board 410*b*.

Decorative sheet 116 is sized to engage, for example, assembled frame legs 102*a*, 102*b*, and 104*b*. Decorative sheet 116 does not engage frame leg 104*a* due to placement of pins 404 and groove 412 on baking board 410. FIG. 19*a* and 19*b* are front pictorial views of backing board 410. Backing board 410 is typically composed of paper board, styrofoam or laminated foam board, sized to snugly fit within assembled frame legs 102*a*, 102*b*, 104*a*, 104*b*. Groove 412 is cut out of backing board 410 in order to receive the protrusion of pins 404 when assembled. Alternatively, holes 414 are drilled or cut in backing board 410.

Assembled layers of picture frame assembly are secured in place by application of retainer clips 122. Arrangement of retainer clips on back of picture frame assembly 400 is shown as in FIG. 5. As with previous embodiment, hangar clip 124 may be used to enable wall display of picture frame assembly 400. Placement of hanger clip is as shown in FIG. 5.

Fifth Exemplary Embodiment

Figure 21:
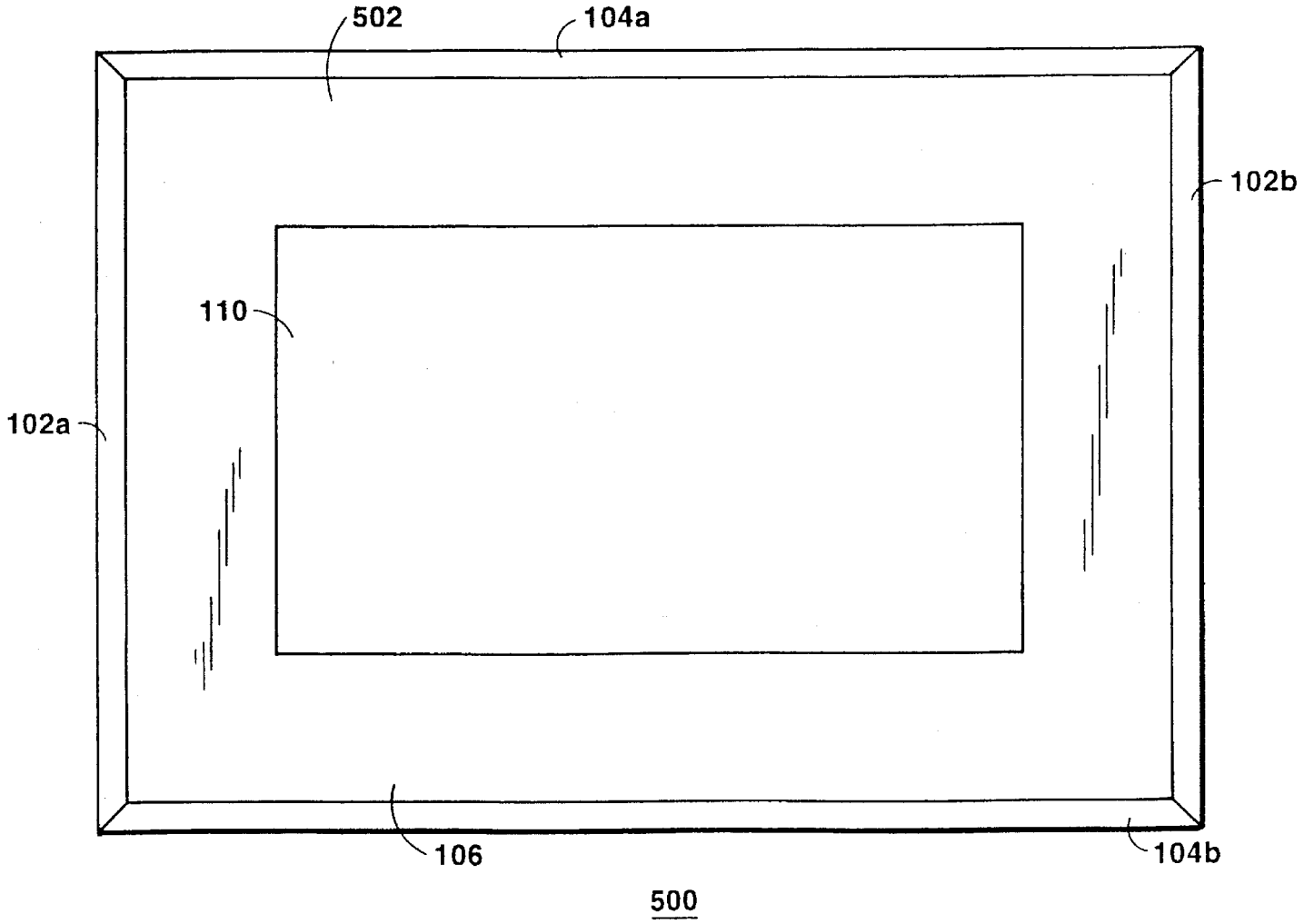
FIG. 21 is a front view of a display frame.

Referring now to FIG. 21, there is shown a front view of a fifth exemplary embodiment of the invention, picture frame assembly 500. In FIG. 21 mat 502 is used. This embodiment may be used for display of photographs and the like. An alternative construction and means for mounting is employed with mat 502, described in detail below. Where like parts from previous embodiment are shown in the figures, like reference numbers are used. Where new parts are introduced in present embodiment, new reference numbers are used.

Figure 22:
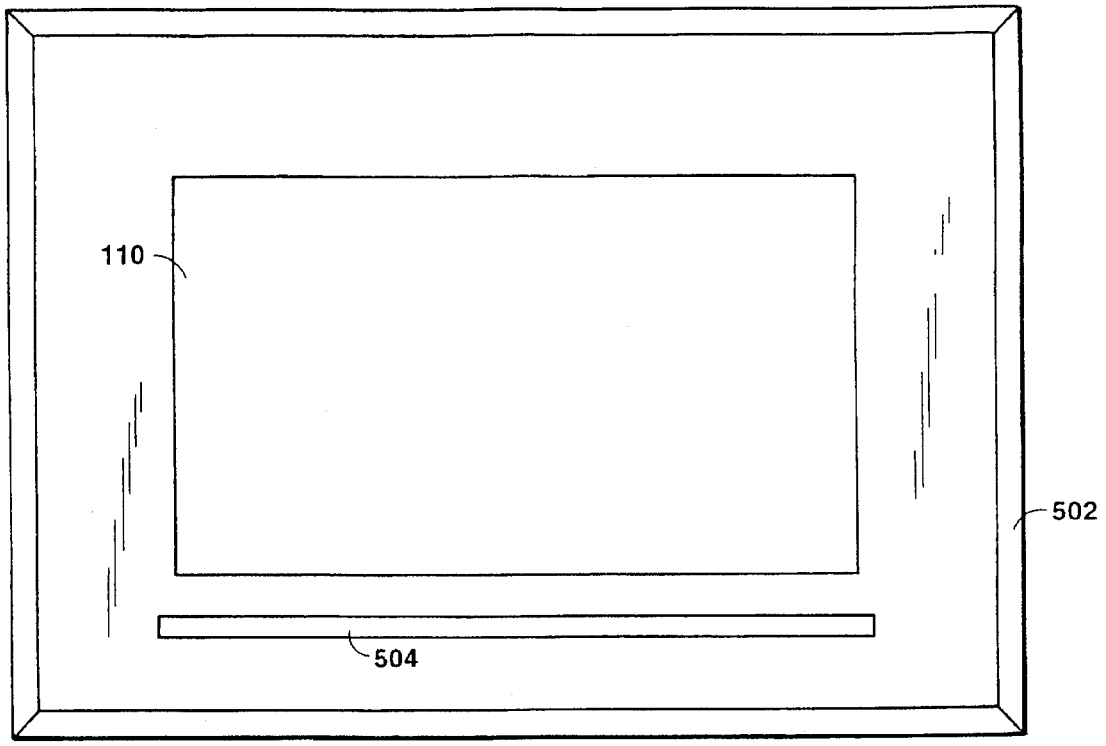
FIG. 22 is a rear view of a mat having an envelope pocket formed therein.

As shown in FIG. 22, mat 502 is constructed with envelope pocket 504. Position of envelope pocket 504 is similar to position of shelf 204 on mat 202 in second embodiment. Herein, rather than resting artwork 112 on, for example, shelf 204, envelope pocket 504 operates to receive bottom margin 506 on artwork 112.

Figure 23:
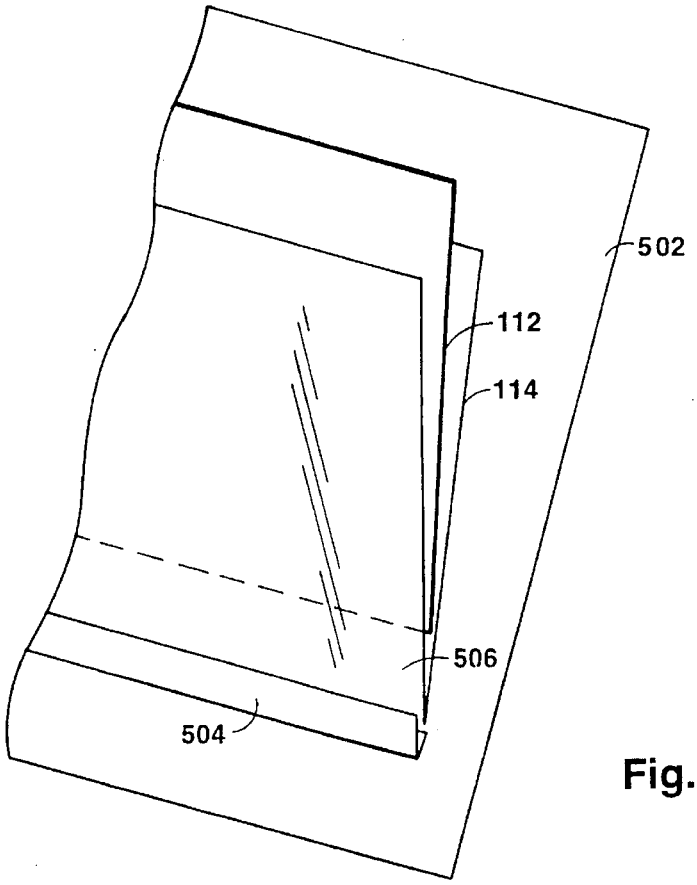
FIG. 23 is an exploded assembly drawing of folded transparent material placed in envelope pocket on mat.

Artwork 112 is encased in foldover MYLAR 114. Thus assembled, foldover MYLAR 114 with artwork 112 is slid into envelope pocket 504 on back of mat 502. FIG. 23 is an exploded assembly drawing of foldover MYLAR 114 placed in envelope pocket 504. Present invention also uses decorative sheet 116, sized to snugly fit assembled frame legs 102*a*, 102*b*, 104*a*, 104*b*. Pressure board 117 of layered pressure assembly may also be used in present mounting method. Herein, pressure board 117 operates in conjunction with envelope pocket 504 to secure placement of artwork 112 in picture frame assembly 500. Backing board 118 shown in FIG. 3, from first embodiment, may also be used in present embodiment. Backing board 118 is typically composed of paper board, styrofoam or laminated foam board, sized to snugly fit within assembled frame legs 102*a*, 102*b*, 104*a*, 104*b*.

Assembled layers of picture frame assembly are secured in place by application of retainer clips 122. Arrangement of retainer clips on back of picture frame assembly 300 may be as shown in FIG. 5. As with previous embodiment, hangar clip 124 may be used to enable wall display of picture frame assembly 300. Placement of hanger clip is as shown in FIG. 5.

Sixth Exemplary Embodiment

Figure 24:
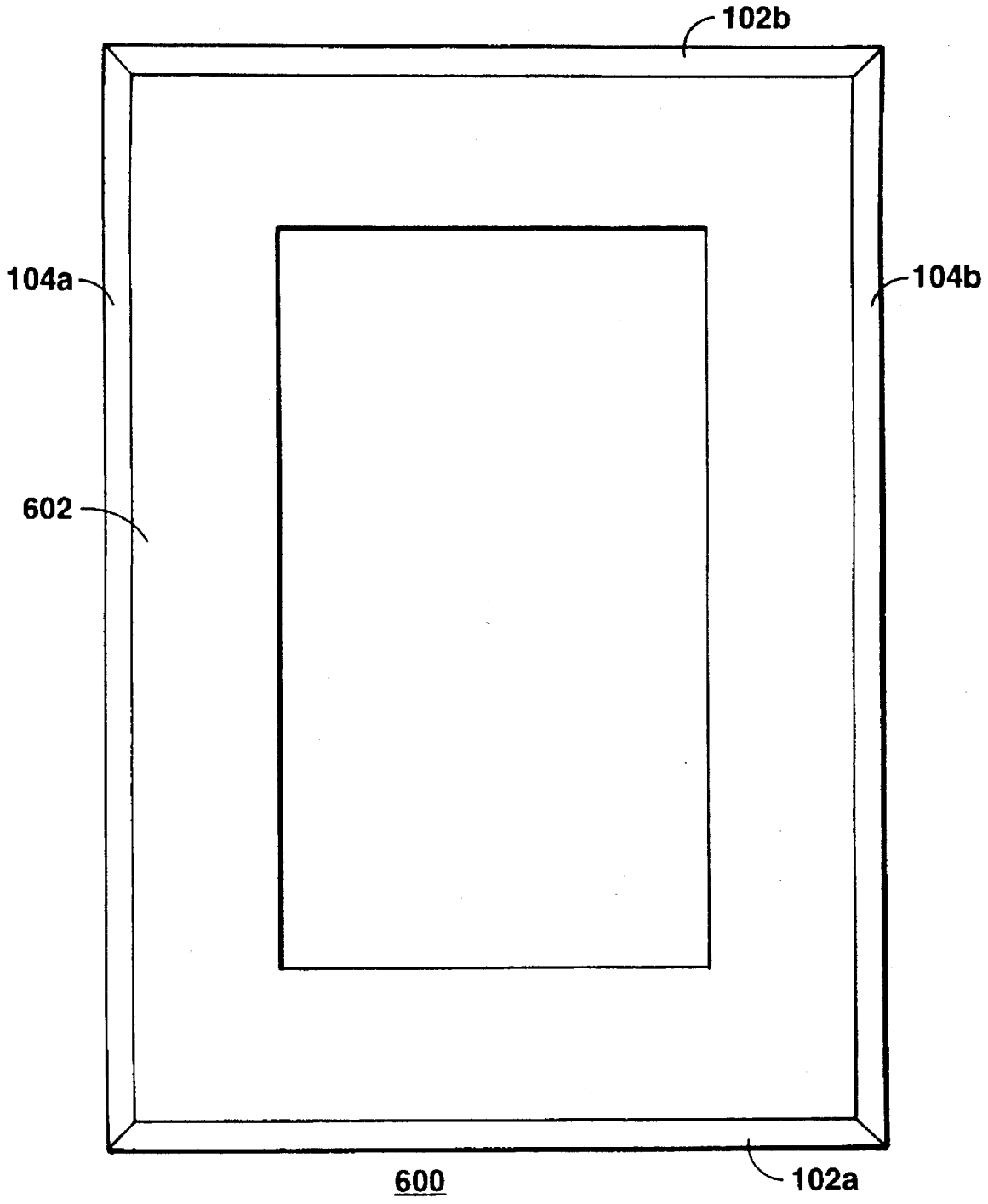
FIG. 24 is a front view of a display frame.
Figure 30:
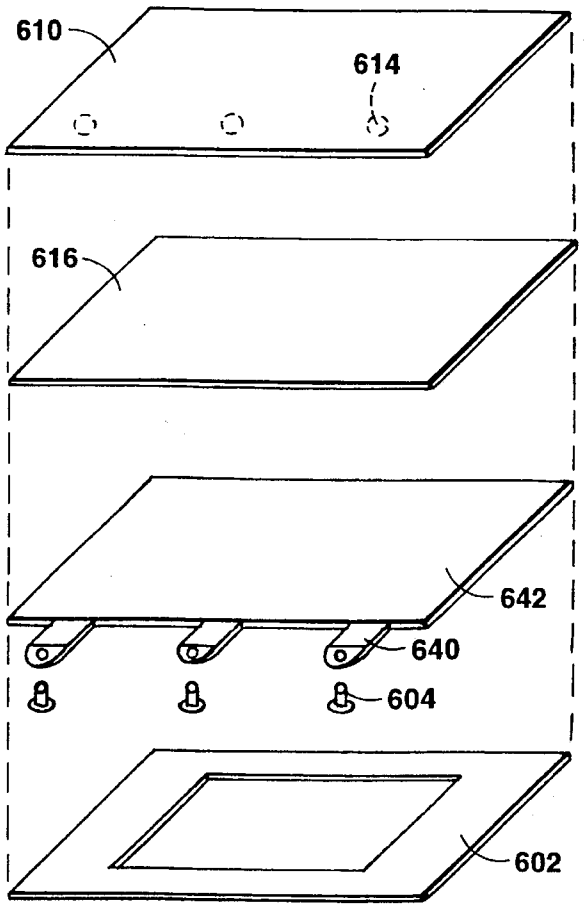
FIG. 30 is an exploded assembly view of pins 604 inserted into top end 644 of extension tabs 640 in picture frame assembly 600.

Referring now to FIG. 24, there is shown a front view of a sixth exemplary embodiment of the invention, picture frame assembly 600. Pins 604 are shown in FIG. 25, and FIGS. 26*a*, 26*b*, and 26*c*. In FIG. 30 mat 602, pins 604, and backing board 610 with holes 614 are used. Mat 602, pins 604 and backing board 610 are used for display of various album pages 306, 326*a*, 326*b* for collectors materials. An alternative means for constructing pins 604 and method for mounting is employed in the present embodiment, described in detail below. Where like parts from previous embodiment are shown in figures, like reference numbers are used, Where new parts are introduced in present embodiment, new reference numbers are used.

Figure 25:
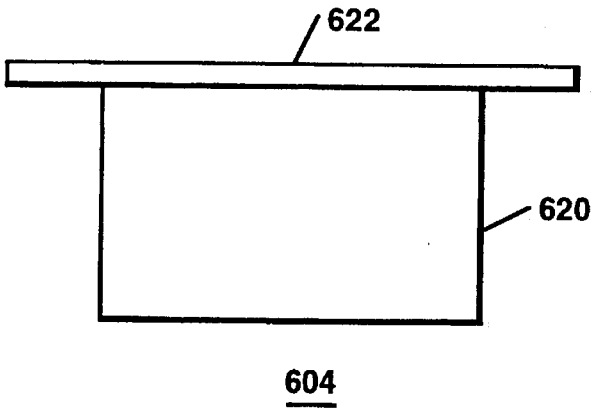
FIG. 25 is a side isometric view of pin 604.
Figure 26B:
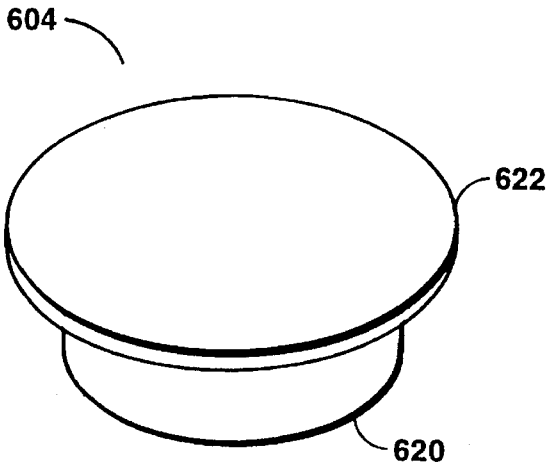
FIG. 26*b* is a top isometric view of aluminum peg 620 with flat disc 622.
Figure 26A:
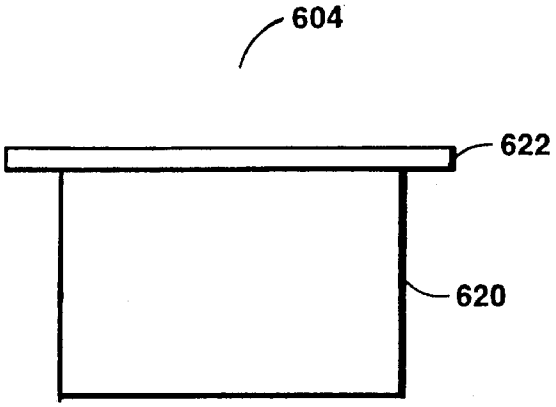
FIG. 26*a* is a side pictorial view of aluminum peg 620 with flat disc 622.
Figure 26C:
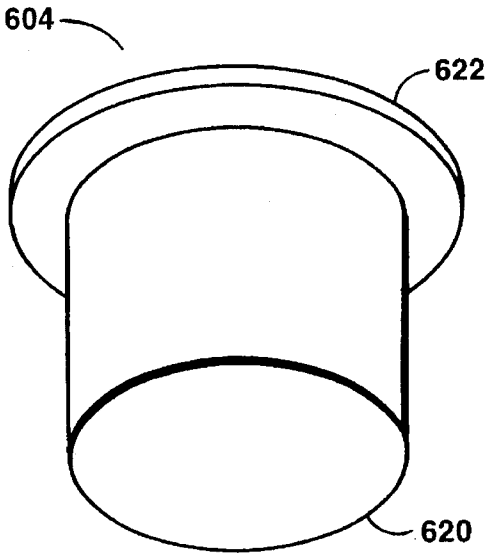

In contrast to previous embodiments, present embodiment employs pins 604 used in conjunction with holes 614 in backing board 610. FIG. 25 shows pins 604, for example, made out of aluminum pegs 620 of, for example ⅛ inch length, topped with a flat disc 622. Such pins 604 may also be formed of plastic or other such durable, pliable material. Refer to FIG. 18 for album page 406 with holes 408. Aluminum pegs 620 are sized to fit snugly in existing punched holes 408 in album page 406. Flat disc 622 is constructed with a slightly larger radius than aluminum peg 620 and affixed to top of aluminum peg 620 forming pin 604. FIGS. 26*a* and 26*b* are side pictorial and top isometric views of pins 604. Pins 604 are inserted through existing punched holes 408 of album page 406 into holes 614 of backing board 610. The formation of pins 604 with flat disc 622 topping aluminum peg 620 provides for secure placement and support of album page 406 in picture frame assembly 600.

Flat disc 622 is constructed with a slightly greater diameter than aluminum peg 620. Aluminum pin 604 may be made, for example, from an aluminum rod having a part of .one end pressed into a flat disc 622. As an alternative construction technique, pin 604 may, for example, be formed by affixing flat disc 622 to top of aluminum peg 620.

Figure 27:
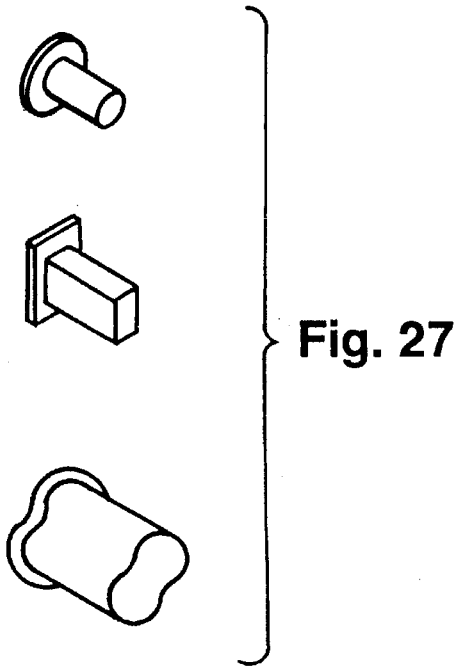
FIG. 27 is a pictorial view of various shaped pins 604.

As an alternative, pins 604 may be formed into various shapes, other than round dowel aluminum pegs 620. FIG. 27, for example, shows pins 604 having cross sections ranging from elliptical to rectangular shapes, to accommodate various shapes of existing punched holes 408 in album pages 406.

Figure 28:
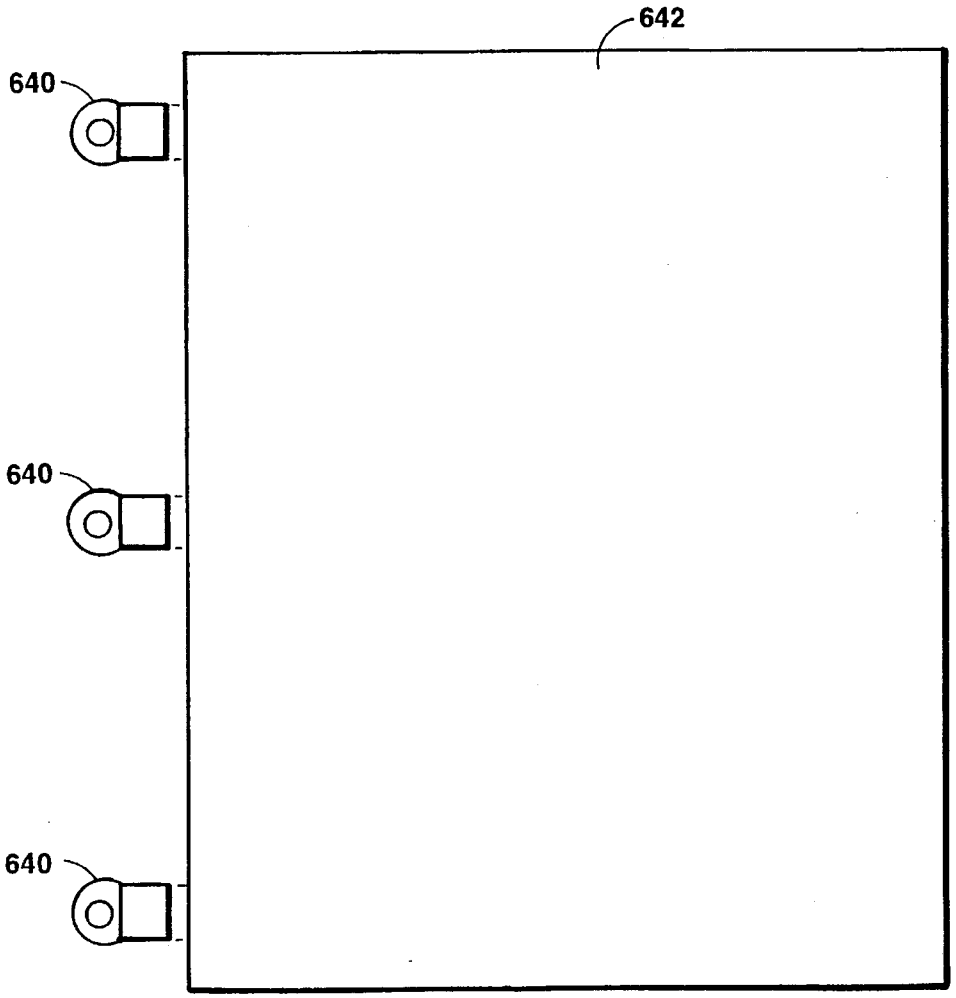
FIG. 28 is a pictorial view of extension tabs 640 affixed to display item 642.

Turning now to FIG. 28, in a preferred embodiment of the invention it was found suitable to use picture frame assembly 600 for display of artwork not held in an album page. As a variation of previous embodiment, extension tabs 640 are used as a substitute to existing punched holes 408 of album page 406. Extension tabs 640 can thus be used to convert any flat display item 642 for use in picture frame assembly 600 designed for display of album pages 406. In FIG. 28, for example, it was found that by affixing extension tabs 640 to backside of display item 642, a unique type of "album page" was created. The extension tabs 640 in the present embodiment are treated in the same manner as the existing punched holes 408 in the previous embodiment.

As a still further alternative, the artwork may simply have holes punched along one edge for the pins to pass through. The pins then hold the art work in place in the picture frame.

Figure 29:
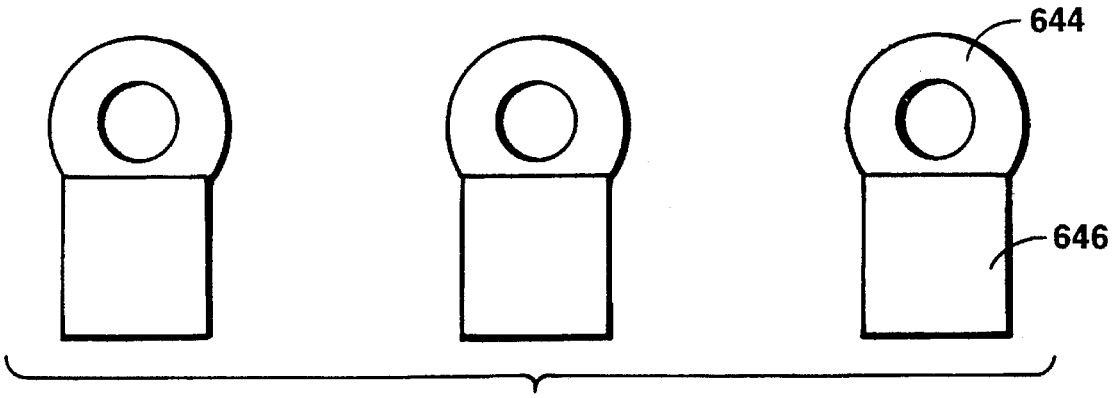
FIG. 29 is a front view of extension tabs 640 showing top end 644 and bottom end 646.

FIG. 29 is a top view of extension tabs 640. Extension tabs 640 are constructed of a top end 644 and a bottom end 646. Top end 644 is formed in the shape of existing punched hole 608 on album pages 406. Bottom end 646 is formed as a tab made of heavy weight paper or construction paper, preferably archival quality material. One surface of the tab is layered with an adhesive substance. Such adhesive enables affixing the extension tabs 640 to the backside of various display items 642. In FIG. 30 for example, pins 604 can be inserted into fop end 644 of extension tabs 640 in similar manner to insertion in existing punched holes 308 in album pages 306 in FIG. 14. Decorative sheet 116 as in FIG. 14 is sized to engage, for example, assembled frame legs 102*a*, 102*b*, and 104*b*.

Decorative sheet 116 does not engage frame leg 104*a* due to placement of pins 604 and holes 614 in backing board 610. Backing board 610 is typically composed of paper board, styrofoam or laminated foam board, sized to snugly fit within assembled frame legs 102*a*, 102*b*, 104*a*, 104*b*. Holes 614 are cut out of backing board 610 in order to receive the protrusion of pins 604 when assembled.

Assembled layers of picture frame assembly are secured in place by application of retainer clips 122. Arrangement of retainer clips on back of picture frame assembly 400 is shown in FIG. 5, As with previous embodiment, hangar clips 124 may be used to enable wall display of picture frame assembly 400. Placement of hangar clip is shown in FIG. 5.

Seventh Exemplary Embodiment

Figure 31:
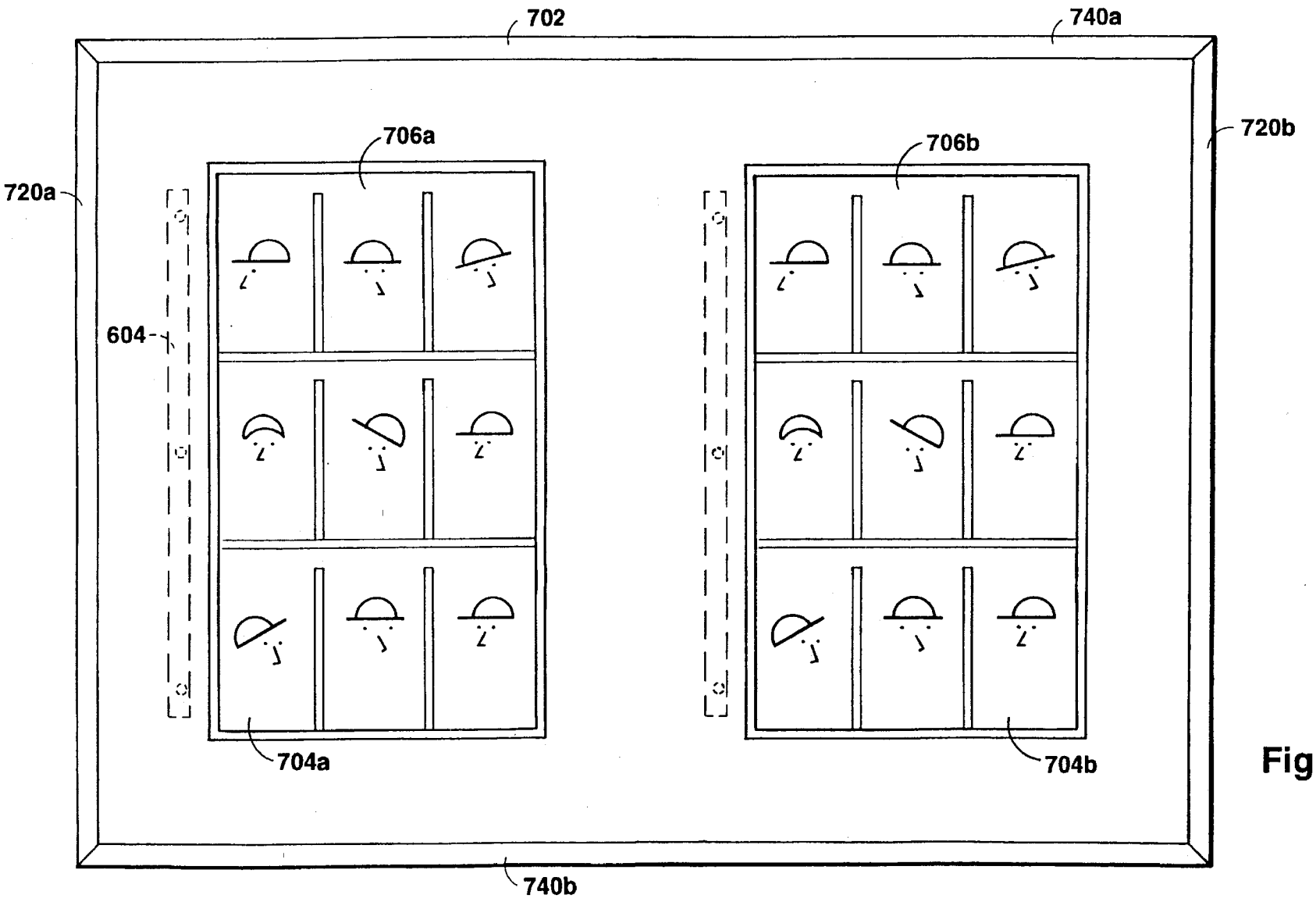
FIG. 31 is a front view of picture frame assembly displaying two album pages 706*a* and 706*b*.

Referring now to FIG. 31, there is shown a front view of a seventh exemplary embodiment of the invention, picture frame assembly 700. In FIG. 31, mat 702 is used. Mat 702 is used for display of at least two album pages 706. Similar construction and means for mounting is employed with mat 702 as with previous embodiments. The seventh embodiment expands the design of mat 702, described in detail below. Where like parts from previous embodiment are shown in the figures, like reference numbers are used. Where new parts are introduced in present embodiment, new reference numbers are used.

As an additional illustrative embodiment of the invention, present embodiment contemplates use of mat 702 constructed with at least two windows 704*a* and 704*b*. Windows 704*a* and 704*b* are each sized to accommodate the display of an album page 706. By enlarging mat 702 to at least twice the size of mat 302 used in picture frame assembly 300, present embodiment allows for aligning a series of album pages 706 in one picture frame assembly 700. It is understood that such a variation or modification may be made to the overall size of the picture frame assembly 700 without departing from the spirit and scope of the present invention.

Alternatively, several small album pages may be displayed in a smaller mat, where the mat has a window for each album page. Pin strip 312 may be used to attach each album page to a backing board.

Figure 32:
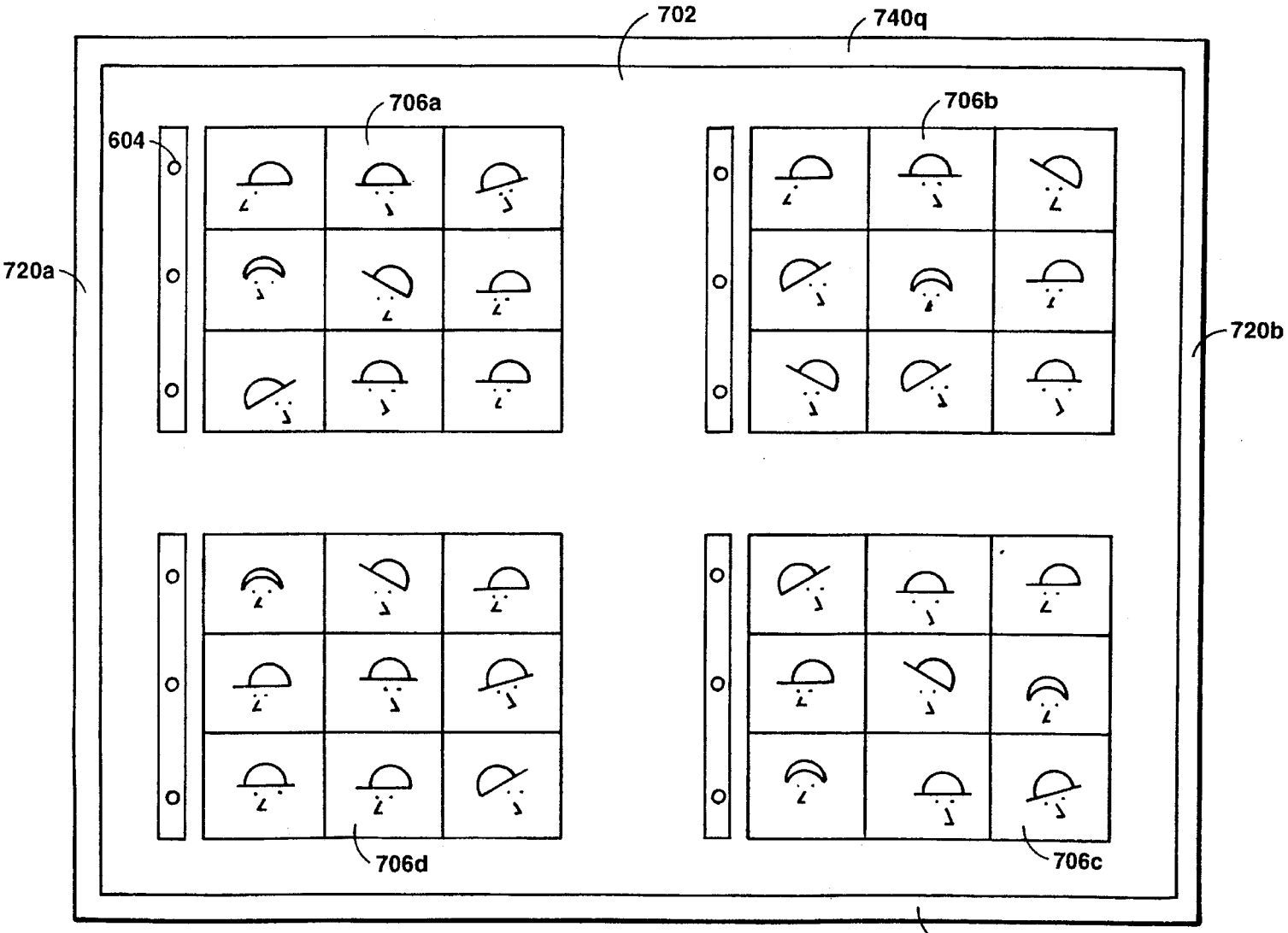
FIG. 32 is a front view of picture frame assembly displaying four album pages 706*a*, 706*b*, 706*c*, 706*d*.

FIG. 31, for example, displays two album pages 706*a*, and 706*b* of baseball cards. FIG. 32 displays four album pages 706*a*, 706*b*, 706*c*, 706*d* in picture frame assembly 700.

Figure 33:
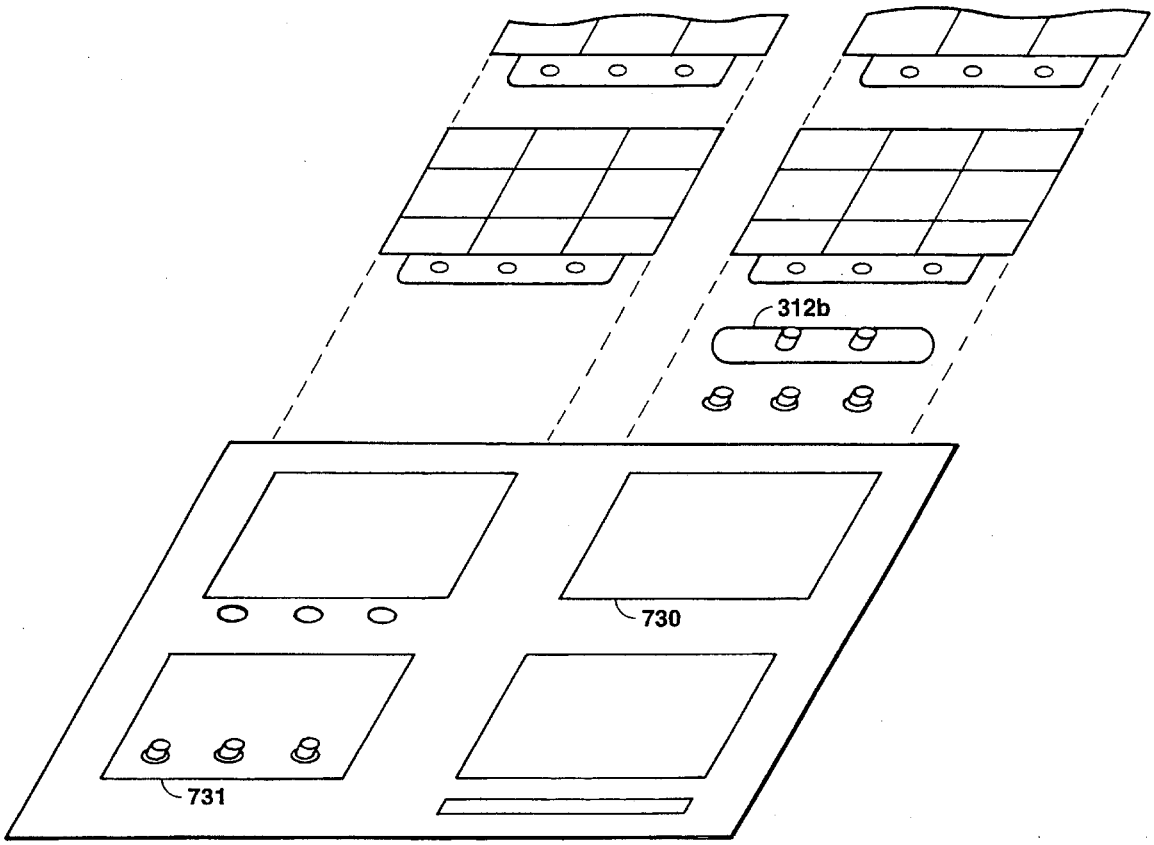
FIG. 33 is an exploded assembly drawing showing multiple means of mounting album pages 706*a*, 706*b*, 706*c*, 706*d*.

FIG. 33 is an exploded assembly drawing showing, for example, multiple means of mounting album pages 706*a*, 706*b*, 706*c*, 706*d*. Typically, one means of mounting may be selected on one mat 702, rather than the combination shown for illustrative purposes. For example, pin strip 312*a*, having two pins, is shown to mount an album page in window 730. As a still further alternative, pins 620 are shown mounting an album page in window 731.

Decorative sheet 716 is sized to engage, for example, assembled frame legs 720*a*, 720*b*, and 740*b*. Decorative sheet does not engage frame leg 740*a* due to placement of pins 704. Backing board 710 is typically composed of paper board, styrofoam or laminated foam board, sized to snugly fit within assembled frame legs 720*a*, 720*b*, 740*a*, 740*b*. It is understood that all items that comprise picture frame assembly 700 are enlarged proportionally to accommodate the variation in size of mat 702.

Figure 34:
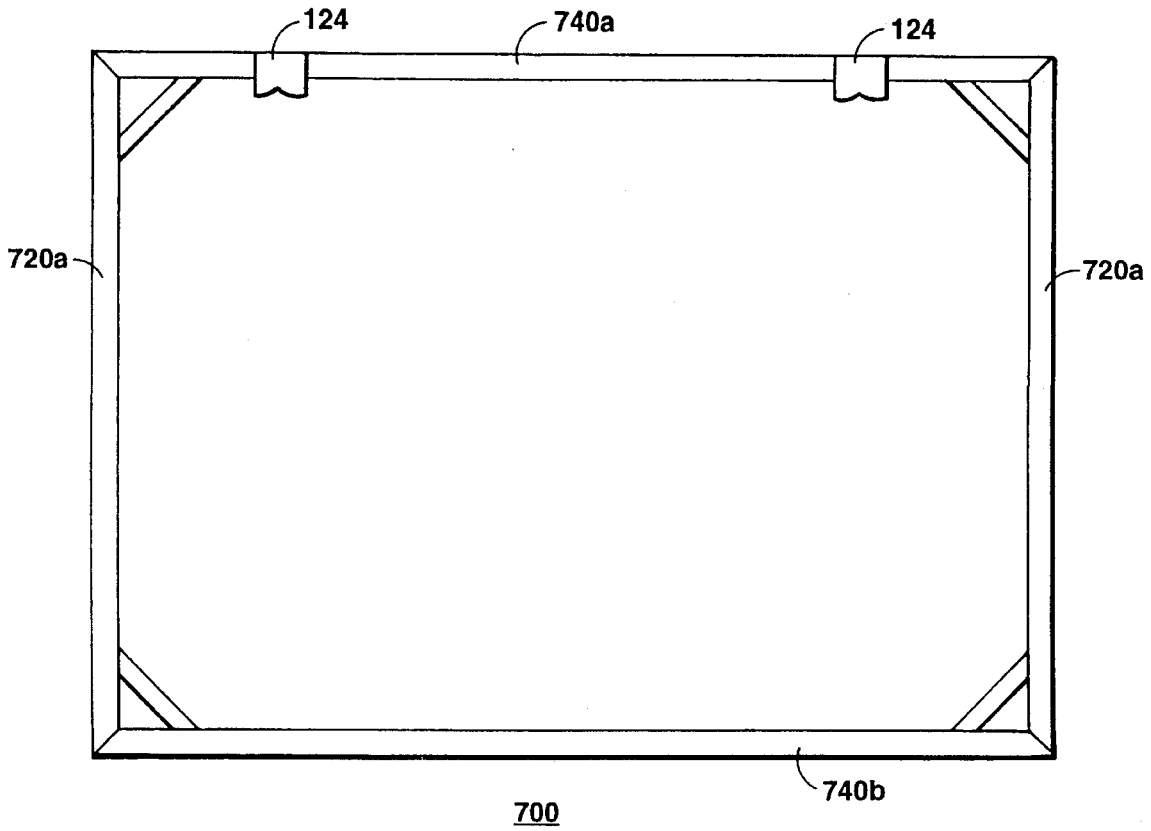
FIG. 34 is a rear view of picture frame assembly 700.

Assembled layers of picture frame assembly are secured in place by application of retainer clips 122. Arrangement of retainer clips on back of picture frame assembly 700 is shown in FIG. 5. As with previous embodiments, hangar clip 124 may be used to enable wall display of picture frame assembly 700. In a preferred embodiment it was found that two hangar clips 124 positioned, for example, as in FIG. 34, were adequate to suspend increased weight of picture frame assembly 700.

Eighth Exemplary Embodiment

Figure 35:
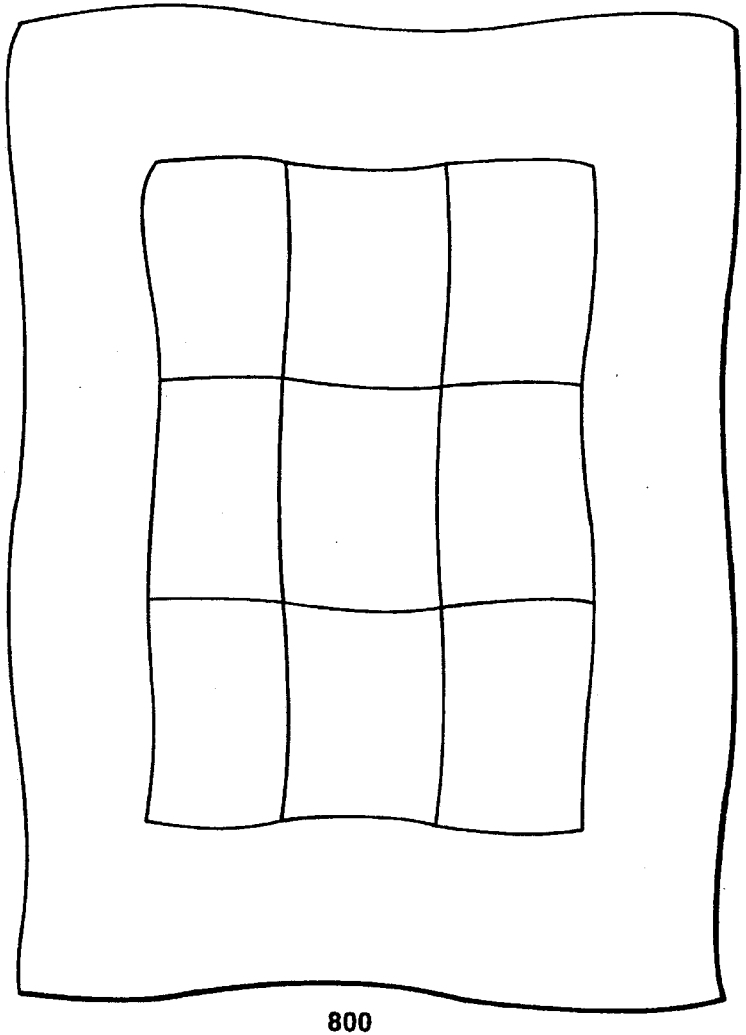
FIG. 35 is a front view of picture frame assembly.

Referring now to FIG. 35, there is shown a front view of an eighth exemplary embodiment of the invention, picture frame assembly 800. In the eighth exemplary embodiment shown in FIGS. 35, 36, 37, and 38, mat 802 and step cut out mat 804 are used for display of various album pages from collector's materials. FIG. 35, for example, displays an album page 806 of baseball cards. An alternative construction and means for mounting is employed with mat 802 and step cut out mat 804, described in detail below. Where like parts from previous embodiment are shown in the figures, like reference numbers are used. Where new parts are introduced in present embodiment, new reference numbers are used.

Figure 37:
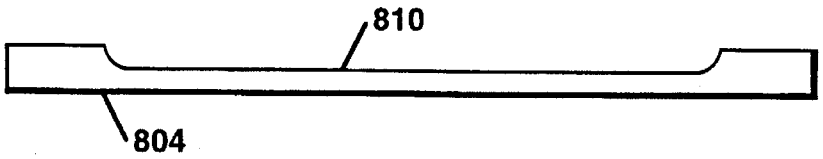
FIG. 37 is a cross sectional view of FIG. 36.
Figure 36:
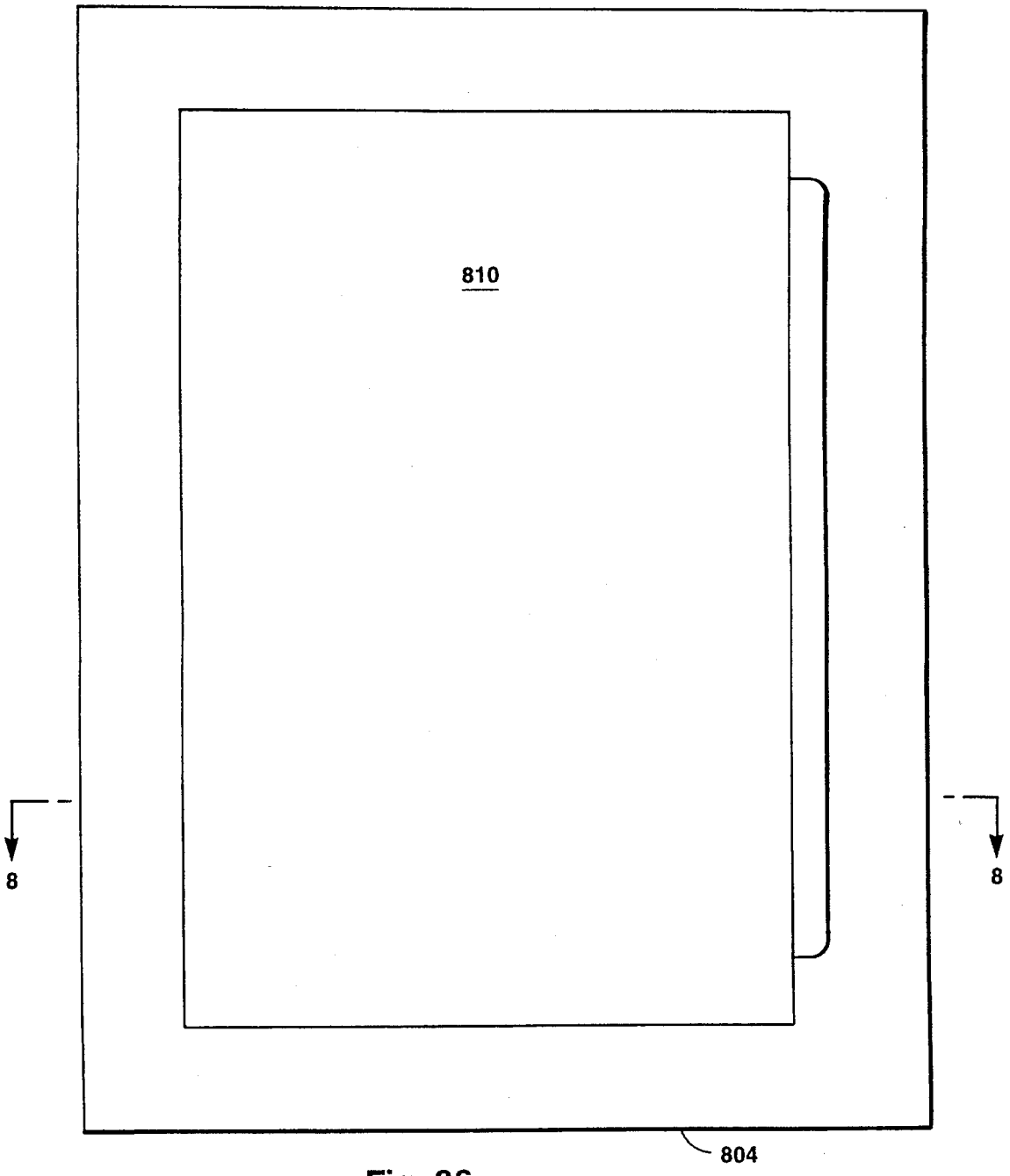
FIG. 36 is a front view of step cut out mat 804.

In contrast to previous embodiments, present embodiment employs step cut out mat 804 used in conjunction with mat 802. FIG. 36 shows a top view of step cut out mat 804. FIG. 37 shows a cross-sectional view of step cut out mat 804 along line 8—8. Step cut out mat 804 is constructed with a recess 810 for receiving edge of album page 806. Recess 810 is constructed in mat 804 with parallel dimensions to album page 806.

Figure 38:
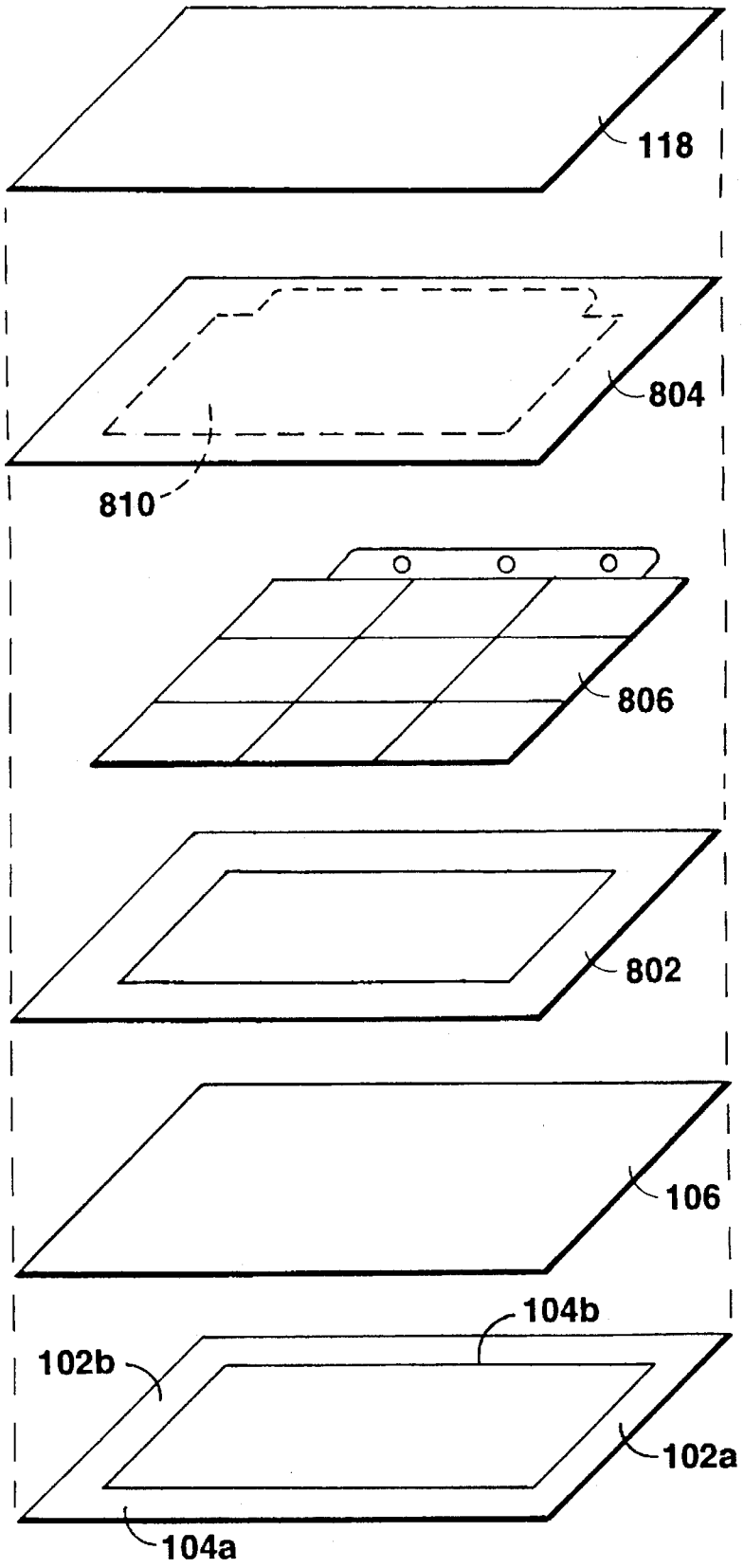
FIG. 38 is an exploded assembly drawing of picture frame assembly using step cut out mat 804.

FIG. 38 shows an exploded assembly drawing of picture frame assembly 800. Assembled frame legs 102*a*, 102*b*, 104*a*, 104*b* hold transparent plate 106. Mat 802 is assembled against transparent plate 106. Album page 806 is placed within recess 810 of step cut out mat 804. Step cut out mat 804 provides an alternative secure suspension system for picture frame assembly.

The final layer in picture frame assembly 800 is backing board 118. Assembled layers of picture frame assembly 800 are secured in place by retainer clips 122. Arrangement of retainer clips on back of picture frame assembly 800 is shown in FIG. 5. As with previous embodiment, hangar clip 124 may be used to enable wall display of picture frame assembly 800. Placement of hangar clip is shown in FIG. 5.

What is claimed is:

1. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat, said retainer formed from at least one sheet of transparent material, said desired materials held by said retainer for viewing, said retainer having holes formed therein;

a backing board to form a back support in said frame to hold said transparent plate, said desired materials, said mat, and said retainer within said frame;

a pin passing through at least one of said holes in said retainer, said pin holding said retainer in predetermined relationship to said opening in said mat;

attachment means for fastening said hacking board within said frame.

2. The display assembly as in claim 1 further comprising:

said pin is positioned in a hole in said backing board.

3. The display assembly as in claim 1 further comprising:

said pin is formed from durable material.

4. The display assembly as in claim 1 further comprising:

said pin is positioned in a hole in said mat.

5. The display assembly as in claim 1 further comprising:

said pin is plastic and is molded to a base.

6. A display assembly, comprising:

a frame, said frame forming a first opening for the display of desired materials;

a transparent plate mounted within said frame and covering said first opening, said transparent plate permitting viewing of said desired materials through said first opening and protecting said desired materials said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat;

a backing board to form a back support in said frame to hold said transparent plate, said desired materials, said mat, and said retainer within said frame;

a at least one pin, said at least one pin being positioned in a hole in said backing board, and said at least one pin passing through a hole in said retainer.

7. The display assembly as in claim 6 further comprising:

said at least one pin is attached to a base.

8. The display assembly as in claim 6 further comprising:

said at least one pin is positioned in a hole in said backing board.

9. The display assembly as in claim 6 further comprising:

said at least one pin is plastic and is molded to a base, and said base fits into an opening in said mat.

10. The display assembly as in claim 6 further comprising:

said retainer is a plastic sheet having said hole formed along one side, said pin passing through said hole.

11. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame:

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat;

a backing board to form a back support in said frame to hold said transparent plate, said desired materials, said mat, and said retainer within said frame;

a pressure board to increase compressive forces between said retainer and said backing board, said pressure board formed as a sheet having an opening therein, said pressure board located in said frame between said retainer and said backing board so that compressive forces between said backing board and said mat substantially pass through said pressure board and are concentrated to pass through a portion of said retainer.

12. The display assembly as in claim 11 further comprising:

a retainer clip to apply force between said frame and said backing board, said retainer clip sized to direct compressive forces through said pressure board to concentrate said compressive forces through said retainer.

13. The display assembly as in claim 11 further comprising:

said transparent plate is transparent to light in the visible wavelength range and absorbent in the ultra-violet wavelength range to protect said desired materials from ultra-violet wavelength radiation striking said transparent plate.

14. The display assembly as in claim 11 further comprising:

said transparent plate is made of ultra-violet absorbing glass.

15. The display assembly as in claim 11 further comprising:

said transparent plate is made of ultra-violet absorbing plastic.

16. The display assembly as in claim 11 further comprising:

said transparent plate is transparent to light in the visible wavelength range and reflective in the ultra-violet wavelength range to protect said desired materials from ultra-violet wavelength radiation striking said transparent plate.

17. The display assembly as in claim 11 further comprising:

said transparent plate is made of ultra-violet reflecting glass.

18. The display assembly as in claim 11 further comprising:

said transparent plate is made of ultra-violet reflecting plastic.

19. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a retainer to hold said desired materials in said second opening of said mat, said retainer is a sheet having at least one hole formed along one side;

a backing board to hold said transparent plate, said desired materials, said mat, and said retainer within said frame;

a at least one pin positioned in a hole in said backing board to hold said desired materials in place.

20. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

an album page to hold said desired materials in said second opening of said mat, said album page formed with punched holes;

a pin passing through at least one of said holes in said album page, said pin holding said album page in fixed relationship to said mat;

a backing board with holes formed therein, said pin inserted into said holes in said backing board for anchoring said album page within said frame; and, attachment means for fastening said backing board within said frame to anchor said backing board to form a back support.

21. The display assembly as in claim 20 further comprising:

said pin is positioned through at least one of said holes in said album page and at least one of said holes in said backing board.

22. The display assembly as in claim 20 further comprising:

said pin is formed as a rod having a flat disc end portion, said flat disc having a diameter greater than said rod.

23. The display assembly as in claim 22 further comprising:

said pin is made out of durable material.

24. A display assembly, comprising:

a frame, said frame forming a first opening for the display of desired materials;

a transparent plate mounted within said frame and covering said first opening, said transparent plate permitting viewing of said desired materials through said first opening and protecting said desired materials, said transparent plate having a first side turned away from an inside of said frame and a second side turned toward said inside of said frame;

a mat mounted within said frame, said mat adjacent to said second side of said transparent plate, said mat having a second opening, said second opening forming a window for viewing said desired materials, said second opening in said mat being smaller than said first opening formed by said frame;

a flat display item for display in said display assembly;

at least one extension tab with a hole formed therein affixed to a backside of said flat display item;

a pin passing through at said hole in said extension tab, said pin holding said display item in fixed relationship to said mat;

a backing board with holes formed therein, said pin inserted into said holes in said backing board for anchoring said display item within said frame;

attachment means for fastening said backing board within said frame to anchor said backing board to form a back support.

* * * * *